US009878551B2

(12) United States Patent
Shimizu et al.

(10) Patent No.: US 9,878,551 B2
(45) Date of Patent: Jan. 30, 2018

(54) LIQUID CONTAINER AND LIQUID EJECTION SYSTEM

(71) Applicant: SEIKO EPSON CORPORATION, Tokyo (JP)

(72) Inventors: Yoshiaki Shimizu, Matsumoto (JP); Taku Ishizawa, Shiojiri (JP); Yuki Takeda, Matsumoto (JP); Shuichi Koganehira, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/344,663

(22) Filed: Nov. 7, 2016

(65) Prior Publication Data

US 2017/0113466 A1 Apr. 27, 2017

Related U.S. Application Data

(63) Continuation of application No. 14/822,312, filed on Aug. 10, 2015, now Pat. No. 9,505,223, which is a (Continued)

(30) Foreign Application Priority Data

Jul. 15, 2010 (JP) ..... 2010-160358
Jul. 15, 2010 (JP) ..... 2010-160361
(Continued)

(51) Int. Cl.
*B41J 2/175* (2006.01)
*B41J 2/19* (2006.01)

(52) U.S. Cl.
CPC ..... *B41J 2/17506* (2013.01); *B41J 2/175* (2013.01); *B41J 2/1752* (2013.01); (Continued)

(58) Field of Classification Search
CPC .... B41J 2/175; B41J 2/17503; B41J 2/17506; B41J 2/17509; B41J 2/1752; B41J 2/17523; B41J 2/17553
See application file for complete search history.

(56) References Cited

U.S. PATENT DOCUMENTS 4,769,658 A 9/1988 Oda et al.
5,148,194 A 9/1992 Asai et al.
(Continued)

FOREIGN PATENT DOCUMENTS

CN 1111568 A 11/1995
CN 2412737 Y 1/2001
(Continued)

OTHER PUBLICATIONS

English translation of the International Search Report dated Oct. 11, 2011 in International Application No. PCT/JP2011/003715.

*Primary Examiner* — Anh T. N. Vo
(74) *Attorney, Agent, or Firm* — Foley & Lardner LLP

(57) ABSTRACT

A liquid container for supplying a liquid to a liquid ejection apparatus comprises: a liquid chamber provided to store the liquid; an air chamber connected with the liquid chamber to introduce the outside air into the liquid chamber with consumption of the liquid in the liquid chamber; an open-air hole provided to introduce the outside air into the air chamber; and a liquid inlet provided to fill the liquid into the liquid chamber, wherein the liquid inlet is located at a lower position than the open-air hole, in a filling attitude of the liquid container in which the liquid is filled into the liquid chamber.

4 Claims, 24 Drawing Sheets

Related U.S. Application Data continuation of application No. 14/556,799, filed on Dec. 1, 2014, now Pat. No. 9,358,795, which is a continuation of application No. 14/170,993, filed on Feb. 3, 2014, now Pat. No. 8,926,073, which is a continuation of application No. 13/212,921, filed on Aug. 18, 2011, now Pat. No. 8,678,567, which is a continuation of application No. PCT/JP2011/003715, filed on Jun. 29, 2011.

(30) Foreign Application Priority Data

Sep. 3, 2010 (JP) ..... 2010-197272
Sep. 3, 2010 (JP) ..... 2010-197274
Sep. 3, 2010 (JP) ..... 2010-197275

(52) U.S. Cl.
CPC ..... *B41J 2/17513* (2013.01); *B41J 2/17523* (2013.01); *B41J 2/17553* (2013.01); *B41J 2/19* (2013.01)

(56) References Cited

U.S. PATENT DOCUMENTS 5,933,173 A * 8/1999 Solero ..... B41J 2/17506 347/85
6,007,193 A 12/1999 Kashimura et al.
6,099,114 A 8/2000 Sasaki
6,257,711 B1 7/2001 Higuma et al.
6,474,796 B1 11/2002 Ishinaga
6,540,321 B1 4/2003 Hirano et al.
6,550,900 B2 4/2003 Chan et al.
6,726,313 B1 4/2004 Oda et al.
6,796,635 B2 9/2004 Shinada
6,846,072 B2 1/2005 Sato et al.
7,090,341 B1 8/2006 Miyazawa
7,152,954 B2 12/2006 Katayama
7,175,264 B2 2/2007 Qingguo et al.
7,185,977 B2 3/2007 Kyogoku et al.
7,303,271 B2 12/2007 Shimizu et al.
7,350,905 B2 4/2008 Sugahara
7,543,923 B2 6/2009 McNestry
7,543,925 B2 6/2009 Ishizawa et al.
7,607,769 B2 * 10/2009 Umeda ..... B41J 2/17509 347/85
7,699,453 B2 4/2010 Ishizawa et al.
7,712,891 B2 * 5/2010 Ishida ..... B41J 29/02 347/104
7,766,466 B2 8/2010 Taniguchi et al.
8,057,022 B2 * 11/2011 Umeda ..... B41J 2/17509 347/104
8,678,567 B2 3/2014 Shimizu et al.
2001/0024223 A1 9/2001 Thielman et al.
2004/0250874 A1 12/2004 Takano
2005/0110849 A1 5/2005 Mui et al.
2005/0174408 A1 8/2005 Oingguo et al.
2008/0036833 A1 2/2008 Shinada et al.
2008/0079790 A1 4/2008 Kachi
2008/0180499 A1 7/2008 Sugahara et al.
2009/0289972 A1 11/2009 Iino
2012/0038719 A1 2/2012 Shimizu et al.

FOREIGN PATENT DOCUMENTS

CN 2421159 Y 2/2001
CN 202242334 A 5/2012
EP 0640484 A2 3/1995
EP 1149706 A2 10/2001
EP 1359026 A1 11/2003
EP 1403067 A1 3/2004
EP 1502751 A1 2/2005
EP 1661710 A2 5/2006
EP 1772271 A2 4/2007
EP 1908594 A1 4/2008
GB 2417712 A 3/2006
JP S54-042550 U 8/1977
JP 63-267557 A 11/1988
JP 06-320748 A 11/1994
JP 06-340083 A 12/1994
JP 07-076097 A 3/1995
JP 08-290577 A 11/1996
JP 2001-138537 A 5/2001
JP 2001-301196 A 10/2001
JP 2005-001284 A 1/2005
JP 2005-161638 A 6/2005
JP 2005-199693 A 7/2005
JP 2005-219483 A 8/2005
JP 2007-045117 A 2/2007
JP 2007-062189 A 3/2007
JP 2008-073856 A 4/2008
KR 100963037 B1 6/2010
TW 200827176 A 7/2008
WO 2009/072656 A1 6/2009

* cited by examiner

RESIDUAL AMOUNT OF INK: SMALL

Fig.13A RESIDUAL AMOUNT OF INK: SMALL
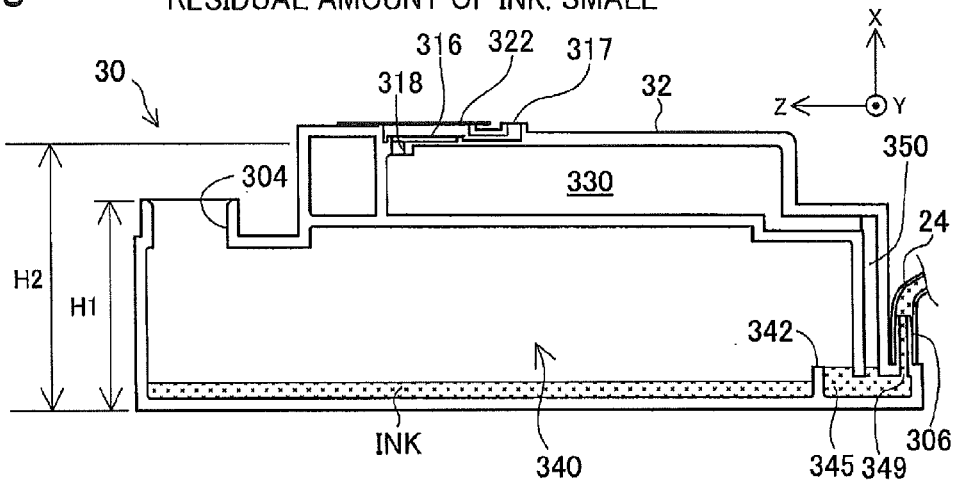
Fig.13B INK FILLING: NORMAL AMOUNT OF INK FILLING
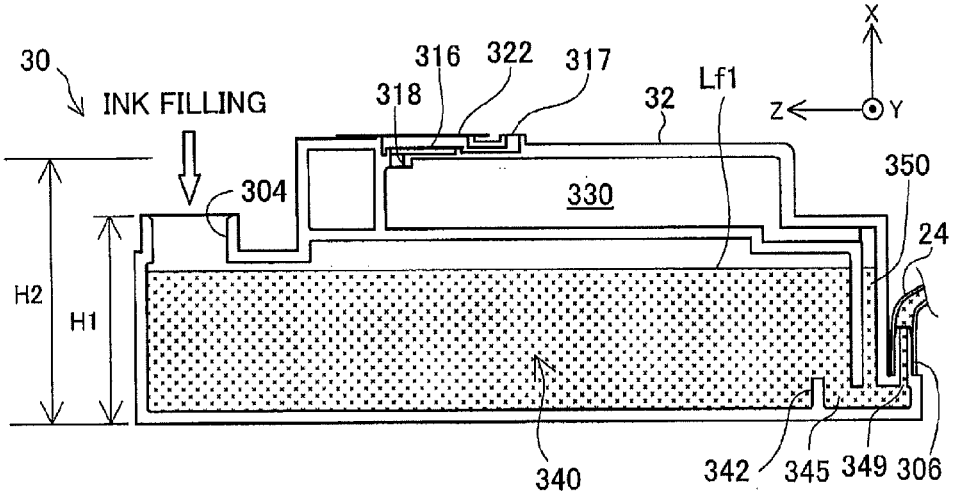
Fig.13C INK FILLING: EXCESS AMOUNT OF INK FILLING
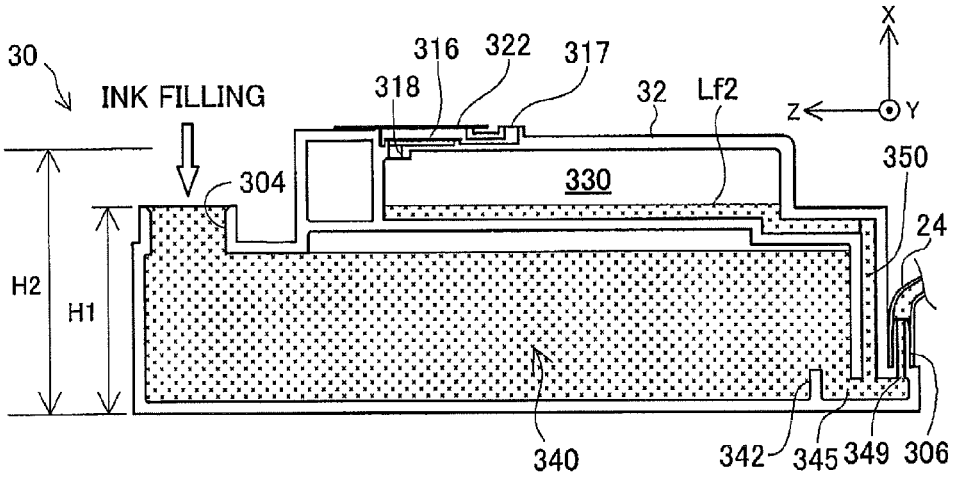

INK FILLING: EXCESS AMOUNT OF INK FILLING

RESIDUAL AMOUNT OF INK: SMALL

LIQUID CONTAINER AND LIQUID EJECTION SYSTEM

CROSS REFERENCE TO RELATED APPLICATIONS

This application is a continuation application of U.S. patent application Ser. No. 14/822,312, filed Aug. 10, 2015, which itself is a continuation of U.S. patent application Ser. No. 14/556,799, filed on Dec. 1, 2014, which is a continuation of U.S. patent application Ser. No. 14/170,993, filed on Feb. 3, 2014, which is a continuation application of U.S. patent application Ser. No. 13/212,921, now U.S. Pat. No. 8,678,567, filed on Aug. 18, 2011, which claims priority to Japanese Patent Application No. 2010-160358, filed on Jul. 15, 2010, Japanese Patent Application No. 2010-160361, filed on Jul. 15, 2010, Japanese Patent Application No. 2010-197272, filed on Sep. 3, 2010, Japanese Patent Application No. 2010-197274, filed on Sep. 3, 2010, Japanese Patent Application No. 2010-197275, filed on Sep. 3, 2010, and International Patent Application No. PCT/JP2011/003715, filed on Jun. 29, 2011, each of which is incorporated herein by reference.

BACKGROUND

Technical Field

The present invention relates to a liquid container and a liquid ejection system including a liquid container.

Related Art

A printer as one example of liquid ejection apparatus causes ink to be ejected from a recording head (also called "head") onto a recording object (for example, print sheet) for printing. A known technique for supplying ink to the recording head supplies ink from an ink cartridge disposed on the recording head to the recording head, while supplying ink from an ink tank disposed outside the liquid ejection apparatus to the ink cartridge or the head via a tube (for example, Patent Literature 1 to 3). The ink tank has the greater capacity for storing a large amount of ink, compared with the ink cartridge. The ink tank has an ink inlet (also called "liquid inlet" or "ink filling port"), and the user readily fills (refills) ink through the ink inlet into the ink tank.

For example, in the technology disclosed in Patent Literature 1, the ink tank has an ink output and ink is supplied to the recording head via the ink outlet and a flexible pipe.

RELATED ART

Patent Literature

Patent Literature 1: JP-A-2005-219483
Patent Literature 2: JP-A-2005-1284
Patent Literature 3: JP-A-2005-199693

SUMMARY

Technical Problems

Separately from the ink inlet, the ink tank may have an open-air hole for introducing the air (atmosphere) into the ink tank with consumption of ink. The user tends to pay attention to the ink inlet, when filling ink through the ink inlet. According to the positional relationship between the ink inlet and the open-air hole, when ink of not less than a predetermined amount is stored in the ink tank, ink may overflow from the open-air hole while ink may not overflow from the ink inlet. Additionally, the user may be unaware of the overflow of ink from the open-air hole.

When the open-air hole is covered with a sheet member having gas-liquid separation function, the sheet member may be wetted with ink overflowing from the open-air hole. The sheet member wetted with ink may impair the original function of the sheet member. For example, the sheet member wetted with ink may not prevent leakage of ink through the sheet member to the outside. For example, the sheet member wetted with ink may lower the air permeability of the sheet member and may interfere with introduction of the air from the open-air hole into the ink tank. This problem is not characteristic of the ink tank but is commonly found in the liquid container which stores liquid to be ejected from the liquid ejection apparatus, and is designed to have the liquid inlet separately from the open-air hole.

Firstly, there is a need to provide the technique of lowering the probability that the liquid overflows from the open-air hole when the liquid is filled through the liquid inlet into the liquid container having the liquid inlet separately from the open-air hole.

When the ink is filled through the ink inlet into the ink tank with a decrease in residual amount of ink in the ink tank, depending on the location of the ink outlet connecting to the inside of the ink tank, the air may flow into the head via the ink outlet and the flexible pipe during ink filling. Invasion of the air into the head may cause failure of printing, such as missing dots.

This problem is not characteristic of the ink tank but is commonly found in the liquid container for supplying liquid to the liquid ejection apparatus, which is designed to enable the liquid to be filled through the liquid inlet into the liquid container.

Secondly, there is a need to provide the technique of lowering the probability that the air flows from the liquid container into the liquid ejection apparatus when the liquid is filled through the liquid inlet into the liquid container.

Various failures and troubles may arise when ink is refilled through the liquid inlet into the ink tank and the ink is supplied from the ink tank to the printer. For example, the ink tank may have an open-air flow path for introducing the air into the ink tank with consumption of ink. This open-air flow path includes the open-air hole. When the ink tank is filled with ink, ink may overflow through the open-air flow path to the outside. In order to ensure stable supply of ink to the recording head of the printer, the ink tank is preferably designed to maintain the ink level in the ink tank, which is exposed to the atmosphere (atmosphere-exposed liquid level), within a preset height range relative to the recording head. For example, the height of the atmosphere-exposed liquid level is kept to be not higher than the height of the recording head, in order to prevent leakage of ink from the recording head. When the ink tank is filled with ink and the ink supply from the ink tank to the recording head is resumed, the atmosphere-exposed liquid level may not be maintained in the preset height range, which results in unstable supply of ink from the ink tank to the recording head. For example, the atmosphere-exposed liquid level may be located above the recording head, which may cause leakage of ink from the recording head by the pressure applied by the ink tank (liquid pressure).

This problem is not characteristic of the ink tank but is commonly found in the liquid container for storing the liquid, which is to be ejected from the liquid ejection apparatus, which is designed to include the liquid inlet for filling the liquid.

Thirdly, there is a need to provide the technique of lowering the probability of the occurrence of trouble or failure in the liquid container having the liquid inlet.

When ink is dropped from the ink inlet to be filled (refilled) into the ink tank, the bubbles may be generated on the surface of the filled ink (water surface). When ink filling continues in the presence of bubbles, bubbles may overflow from the ink inlet.

This problem is not characteristic of the ink tank but is commonly found in the liquid container for storing the liquid, which is to be ejected from the liquid ejection apparatus, which is designed to include the liquid inlet for filling the liquid.

Fourthly, there is a need to provide the technique of lowering the probability that bubbles generated during filling of the liquid into the liquid container overflow from the liquid inlet of the liquid container.

The ink tank may be set in different attitudes, i.e., use attitude in which ink is supplied from the ink tank to the printer and filling attitude in which ink is filled through the ink inlet into the ink tank. When the use attitude is different from the filling attitude, the user may have difficulty in checking the amount of ink remaining in the ink tank in the respective attitudes.

This problem is not characteristic of the ink tank but is commonly found in the liquid container for storing the liquid, which is to be ejected from the liquid ejection apparatus, which is designed to include the liquid inlet for filling the liquid.

Fifthly, there is a need to provide the technique of enabling the user to readily check the level of the liquid remaining in the liquid container having the liquid inlet.

Solution to Problem

In order to achieve at least part of the foregoing, the present invention provides various aspects and embodiments described below.

First Aspect

A liquid container for supplying a liquid to a liquid ejection apparatus, comprising:

a liquid chamber provided to store the liquid;

an air chamber connected with the liquid chamber to introduce the outside air into the liquid chamber with consumption of the liquid in the liquid chamber;

an open-air hole provided to introduce the outside air into the air chamber; and a liquid inlet provided to fill the liquid into the liquid chamber, wherein the liquid inlet is located at a lower position than the open-air hole, in a filling attitude of the liquid container in which the liquid is filled into the liquid chamber.

In the liquid container according to the first aspect, the liquid inlet is located below the open-air hole in the filling attitude. This structure lowers the probability that the liquid overflow from the open-air hole, when the liquid is filled through the liquid inlet into the liquid chamber. Additionally, the user pays attention to the liquid inlet during filling of the liquid. This lowers the probability that the liquid overflows from the liquid inlet.

Second Aspect

The liquid container according to aspect 1, further comprising:

a sheet member provided to separate the open-air hole from outside, the sheet member having gas permeability and liquid impermeability.

In the liquid container according to the second aspect, the sheet member prevents the liquid stored in the liquid chamber from overflowing from the open-air hole to the outside. Additionally, the liquid inlet is located at the lower position than the open-air hole. This structure lowers the probability that the liquid overflows from the open-air hole during filling of the liquid. This results in preventing the sheet member from being wetted with the liquid during filling of the liquid and lowering the probability that the function of the sheet member is damaged.

Third Aspect

The liquid container according to either one of aspects 1 and 2, further comprising:

a connection path provided to have one end open to the air chamber and the other end open to the liquid chamber and thereby connect the air chamber with the liquid chamber, wherein the liquid inlet is located at a lower position than the opening at the one end in the filling attitude.

The structure of the liquid container according to the third aspect lowers the probability that the liquid is introduced to the air chamber during filling of the liquid. This results in further lowering the probability that the liquid overflows from the open-air hole during filling of the liquid.

Fourth Aspect

The liquid container according to any one of aspects 1 to 3, further comprising:

an elastic plug member provided to close the liquid inlet and detachably attached to the liquid inlet, wherein the liquid chamber has an air reserving space to accumulate the air of a volume V1 when the liquid is filled into the liquid chamber to such an extent that liquid level reaches an upper end opening of the liquid inlet in the filling attitude, the liquid container meeting a relational expression of $V1 \geq V2$, wherein V2 represents volume of an inlet adjacent portion of the liquid chamber occupying a location of not lower than height of the liquid inlet, in a use attitude of the liquid container in which the liquid is supplied to the liquid ejection apparatus.

In the liquid container according to the fourth aspect, even when an excess amount, for example, an overflowing amount, of the liquid is filled through the liquid inlet into the liquid container, the air reserving space can accumulate the air of a predetermined volume (volume V1) in the liquid chamber. The volume V1 is not less than the volume V2 of the inlet adjacent portion. This lowers the probability that the plug member is exposed to the liquid in the liquid chamber when the attitude of the liquid container is changed to the use attitude after filling of the liquid. This results in lowering the probability that the quality of the liquid is lowered by, for example, contamination of the liquid with part of the plug member as impurity Fifth Aspect The liquid container according to aspect 4, wherein the air reserving space is a recess formed by a wall face forming the liquid chamber and is open downward in a vertical direction in the filling attitude.

In the liquid container according to the fifth aspect, the air reserving space is readily formed by the recess that is open downward in the vertical direction.

Sixth Aspect

The liquid container according to any one of aspects 1 to 5, wherein in a use attitude of the liquid container in which the liquid is supplied to the liquid ejection apparatus, the open-air hole is disposed on a side closer to an upper face of the air chamber than a bottom face.

The structure of the liquid container according to the sixth aspect lowers the probability that the liquid overflows from the open-air hole in the use attitude of the liquid container, even when the liquid enters part of the air chamber during filling of the liquid.

Seventh Aspect

A liquid container for supplying a liquid to a liquid ejection apparatus, comprising:

a liquid chamber provided to store the liquid;

a liquid inlet connected with the liquid chamber and provided to fill the liquid into the liquid chamber; and a liquid discharge port provided to have one end connecting with the liquid chamber at a preset height from a bottom face of the liquid chamber and the other end open to outside, in a filling attitude of the liquid container in which the liquid is filled into the liquid chamber, the liquid discharge port causing the liquid stored in the liquid chamber to be flowed to outside, wherein the liquid container is installed such that the liquid discharge port is located below the liquid inlet, in a use attitude of the liquid container in which the liquid in the liquid chamber is supplied to the liquid ejection apparatus, and the liquid chamber has a liquid retainer connected with the one end of the liquid discharge port and provided to retain the liquid in the liquid chamber such that the liquid in the liquid discharge port is continuous with the liquid in the liquid chamber without the air, when attitude of the liquid container with the liquid chamber storing the liquid of not less than a predetermined amount is changed from the use attitude to the filling attitude.

The liquid container according to the seventh aspect has the liquid retainer and thereby enables the liquid in the liquid discharge port to be continuous with the liquid in the liquid chamber without the air in the filling attitude. This lowers the probability that the air flows into the liquid ejection apparatus via the liquid discharge port when the liquid is filled into the liquid container.

Eighth Aspect

The liquid container according to aspect 7, wherein the liquid retainer has a partition wall member connected with the bottom face of the liquid chamber to have a height that is not less than the preset height in the filling attitude, the partition wall member blocking a flow of the liquid in a direction away from the one end, when the attitude of the liquid container is changed from the use attitude to the filling attitude.

In the liquid container according to the eighth aspect, the partition wall member blocks the flow of the liquid and thereby enables the liquid in the liquid retainer to be continuous with the liquid in the liquid discharge port without the air. This lowers the probability that the air flows into the liquid ejection apparatus via the liquid discharge port when the liquid is filled into the liquid container.

Ninth Aspect

The liquid container according to aspect 7, wherein the liquid retainer has a porous member located on the bottom face of the liquid chamber to absorb and retain the liquid in the filling attitude, the porous member closing the one end of the liquid discharge port and causing the liquid stored in the liquid chamber to be flowed to the liquid discharge port when the liquid in the liquid chamber is supplied to the liquid ejection apparatus.

In the liquid container according to the ninth aspect, the porous member retains the liquid and thereby enables the liquid in the liquid retainer to be continuous with the liquid in the liquid discharge port without the air. This lowers the probability that the air flows into the liquid ejection apparatus via the liquid discharge port when the liquid is filled into the liquid container.

Tenth Aspect

A liquid container for supplying a liquid to a liquid ejection apparatus, comprising:

a liquid chamber formed by a plurality of wall members to store the liquid;

a liquid inlet provided to fill the liquid into the liquid chamber and to have one end open to outside and the other end open to the liquid chamber;

a plug member provided to close the liquid inlet;

an open-air flow path provided to introduce the outside air into the liquid chamber; and a liquid discharge port provided to supply the liquid stored in the liquid chamber to the liquid ejection apparatus, wherein the open-air flow path includes;

an air chamber provided to have a predetermined volume;

a first flow path provided to connect the air chamber to outside; and a second flow path provided to have an airside opening at one end open to the air chamber and a liquid-side opening at the other end open to the liquid chamber and thereby connect the liquid chamber with the air chamber, wherein a meniscus is formed in the second flow path to retain the liquid, wherein the second flow path including the liquid-side opening and the air-side opening is located below the other end of the liquid inlet, in a use attitude of the liquid container in which the liquid in the liquid container is supplied to the liquid ejection apparatus, and a filling attitude of the liquid container in which the liquid is filled through the liquid inlet into the liquid chamber is a different attitude from the use attitude and causes the air-side opening to be located above the other end of the liquid inlet.

In the liquid container according to the tenth aspect, the air-side opening is located above the other end of the liquid inlet in the filling attitude. This structure lowers the probability that the liquid is introduced into the air chamber during filling of the liquid and thereby the probability that liquid overflows to the outside through the first flow path for connecting the air chamber to the outside. Preventing introduction of the liquid into the air chamber enables the liquid level in the liquid container, which is exposed to the atmosphere, to be kept in a preset height range even in the use attitude immediately after filling of the liquid. Additionally, the second flow path, in which the meniscus is formed, is located below the liquid inlet in the use attitude. This allows for formation of the meniscus for a long time period and keeps the liquid level exposed to the atmosphere constant for a long time period.

Eleventh Aspect

The liquid container according to aspect 10, wherein the liquid inlet is provided in one of the plurality of wall members to have the one end of the liquid inlet open toward a horizontal direction in the use attitude and open upward in a vertical direction in the filling attitude, in order to urge a user to change attitude of the liquid container from the use attitude to the filling attitude when the liquid is to be filled from the liquid inlet into the liquid chamber.

In general, one end of the liquid inlet open upward in the vertical direction makes easier for the user to fill the liquid through the liquid inlet into the liquid chamber. The structure of the liquid container according to the eleventh aspect urges the user to change the attitude of the liquid container to the filling attitude when the user fills the liquid through the liquid inlet into the liquid chamber. This lowers the probability of trouble occurring during filling of the liquid.

Twelfth Aspect

The liquid container according to aspect 11, wherein the plurality of wall members include a plurality of vertically-angled wall members that are vertically-angled relative to a mounting surface, on which the liquid container is mounted, in the use attitude, and the liquid inlet is provided in an air-side wall member that is located close to the air chamber, out of the plurality of vertically-angled wall members.

In the liquid container according to the twelfth aspect, the liquid inlet is readily formed to have one end open toward the horizontal direction in the use attitude and the other end open upward in the vertical direction in the filling attitude.

Thirteenth Aspect

The liquid container according to any one of aspects 10 to 12, further comprising:

a lower limit element provided on a first wall member that is visible from outside, among the plurality of wall members, the lower limit element being used to detect, from outside, that liquid level in the liquid chamber reaches a first threshold value with consumption of the liquid in the liquid chamber in the use attitude; and an upper limit element provided on a second wall member that is visible from outside and is different from the first wall member, among the plurality of wall members, the upper limit element being used to detect, from outside, that the liquid level in the liquid chamber reaches a second threshold value as the liquid is filled through the liquid inlet into the liquid chamber in the filling attitude, wherein the first wall member is vertically-angled relative to a mounting surface on which the liquid container is mounted, in the use attitude, and the second wall member is vertically-angled relative to the mounting surface on which the liquid container is mounted, in the filling attitude.

The liquid container according to the thirteenth aspect has the lower limit element and the upper limit element, which enable the user to readily check the liquid level in the liquid chamber in the respective attitudes.

Fourteenth Aspect

A liquid container for supplying a liquid to a liquid ejection apparatus, the liquid container being set in a use attitude in which the liquid is supplied to the liquid ejection apparatus and in a filling attitude in which the liquid is filled into the liquid container, wherein the use attitude is a different attitude from the filling attitude, the liquid container comprising:

a liquid chamber formed by a plurality of wall members to store the liquid;

a liquid inlet provided to fill the liquid into the liquid chamber;

a liquid discharge port provided to supply the liquid in the liquid chamber to the liquid ejection apparatus;

a lower limit element provided on a first wall member among the plurality of wall members, the first wall member being visible from outside, the lower limit element being used to detect, from outside, that liquid level in the liquid chamber reaches a first threshold value with consumption of the liquid in the liquid chamber in the use attitude; and an upper limit element provided on a second wall member among the plurality of wall members, the second wall member being visible from outside and being different from the first wall member, the upper limit element being used to detect, from outside, that the liquid level in the liquid chamber reaches a second threshold value as the liquid is filled through the liquid inlet into the liquid chamber in the filling attitude, wherein the first wall member is vertically-angled relative to a mounting surface on which the liquid container is mounted, in the use attitude, and the second wall member is vertically-angled relative to the mounting surface on which the liquid container is mounted, in the filling attitude.

The liquid container according to the fourteenth aspect has the lower limit element and the upper limit element, which enable the user to readily check that the liquid level in the liquid chamber reaches the first threshold value or the second threshold value in the respective attitudes.

Fifteenth Aspect

The liquid container according to either one of aspects 13 and 14, wherein the lower limit element forms a horizontal straight line in the use attitude, and the upper limit element forms a horizontal straight line in the filling attitude.

In the liquid container according to the fifteenth aspect, the user can readily check the residual amount of the liquid in the liquid chamber by comparing the liquid level with the lower limit element or the upper limit element in the respective attitudes.

Sixteenth Aspect

A liquid container for supplying a liquid to a liquid ejection apparatus, comprising:

a liquid chamber provided to store the liquid;

a liquid inlet provided to have one end open to outside and the other end open to the liquid chamber and to fill the liquid into the liquid chamber; and a liquid discharge port provided to have a liquid outlet at one end open to the liquid chamber and to supply the liquid in the liquid chamber to the liquid ejection apparatus, wherein in a filling attitude of the liquid container in which the liquid is filled through the liquid inlet into the liquid chamber, the liquid chamber has a specific space that is formed by a wall member forming the liquid chamber and is open downward in a vertical direction, and in the filling attitude, the specific space is located above the other end of the liquid inlet.

In the liquid container according to the sixteenth aspect, the liquid chamber has the specific space that is located above the other end of the liquid inlet, so that the bubbles generated in the liquid chamber during filling of the liquid are accumulated in the specific space. This structure lowers the probability that the bubbles generated during filling of the liquid overflow from the liquid inlet, compared with the conventional liquid container without such specific space.

Seventeenth Aspect

The liquid container according to aspect 16, wherein in the filling attitude, the one end of the liquid inlet is located above the specific space.

In the liquid container according to the seventeenth aspect, the one end of the liquid inlet is located above the specific space. This structure lowers the probability that the bubbles generated during filling of the liquid overflow from the liquid inlet.

Eighteenth Aspect

The liquid container according to either one of aspects 16 and 17, wherein in the filling attitude, the liquid outlet of the liquid discharge port is located below the specific space.

The structure of the liquid container according to the eighteenth aspect lowers the probability that the bubbles generated during filling of the liquid enter the liquid discharge port. This results in lowering the probability that the air bubbles (the air) are introduced from the liquid container into the head of the liquid ejection apparatus and thereby prevents failure of the head, such as missing dots.

Nineteenth Aspect

A liquid ejection system, comprising:

the liquid container according to any one of aspects 1 to 18;

a liquid ejection apparatus having a head for ejecting the liquid onto an object; and a connection pipe disposed to connect the liquid discharge port of the liquid container with the liquid ejection apparatus, the connection pipe causing the liquid stored in the liquid chamber to be flowed to the liquid ejection apparatus.

The liquid ejection system according to the nineteenth aspect provides the liquid ejection system including the liquid container according to any one of the first through the eighteenth aspects. In one example, the liquid ejection system including the liquid container according to any one of the first through the sixth aspects provides the liquid ejection system including the liquid container having the lowered probability that the liquid overflows from the open-air hole during filling of the liquid. In another example, the liquid ejection system including the liquid container according to any one of the seventh through the ninth aspects provides the liquid ejection system having the lowered probability of trouble occurring due to invasion of the air into the liquid ejection apparatus. In still another example, the liquid ejection system including the liquid container according to any one of the tenth through the thirteenth aspects and the fifteenth aspect dependent on the thirteenth aspect provides the liquid ejection system that enables the liquid level in the liquid container exposed to the atmosphere to be maintained in a preset height range from the mounting surface even in the use attitude immediately after filling of the liquid. This keeps the height difference between the head and the liquid level exposed to the atmosphere within a preset range, thus ensuring stable ejection of the liquid from the head. In another example, the liquid ejection system including the liquid container according to any one of the fourteenth aspect and the fifteenth aspect dependent on the fourteenth aspect provides the liquid ejection system including the liquid container that enables the liquid level in the liquid chamber to be readily checked in each of the use attitude and the filling attitude. In still another example, the liquid ejection system including the liquid container according to any one of the sixteenth through the eighteenth aspects provides the liquid ejection system including the liquid container having the lowered probability that the bubbles generated during filling of the liquid overflow from the liquid inlet.

The present invention may be actualized by diversity of applications, for example, a manufacturing system of the above liquid container and a liquid ejection method using the above liquid ejection system, in addition to the liquid container and the liquid ejection system including the liquid ejection apparatus and the liquid container described above.

BRIEF DESCRIPTION OF THE DRAWINGS

FIGS. 13A to 13C show ink filling into the ink tank 30;

DETAILED DESCRIPTION

Some aspects of the invention are described below:

A. Reference Examples

B. Embodiments and Comparative Example

C. Modified Examples

A. Reference Examples

Figure 1:
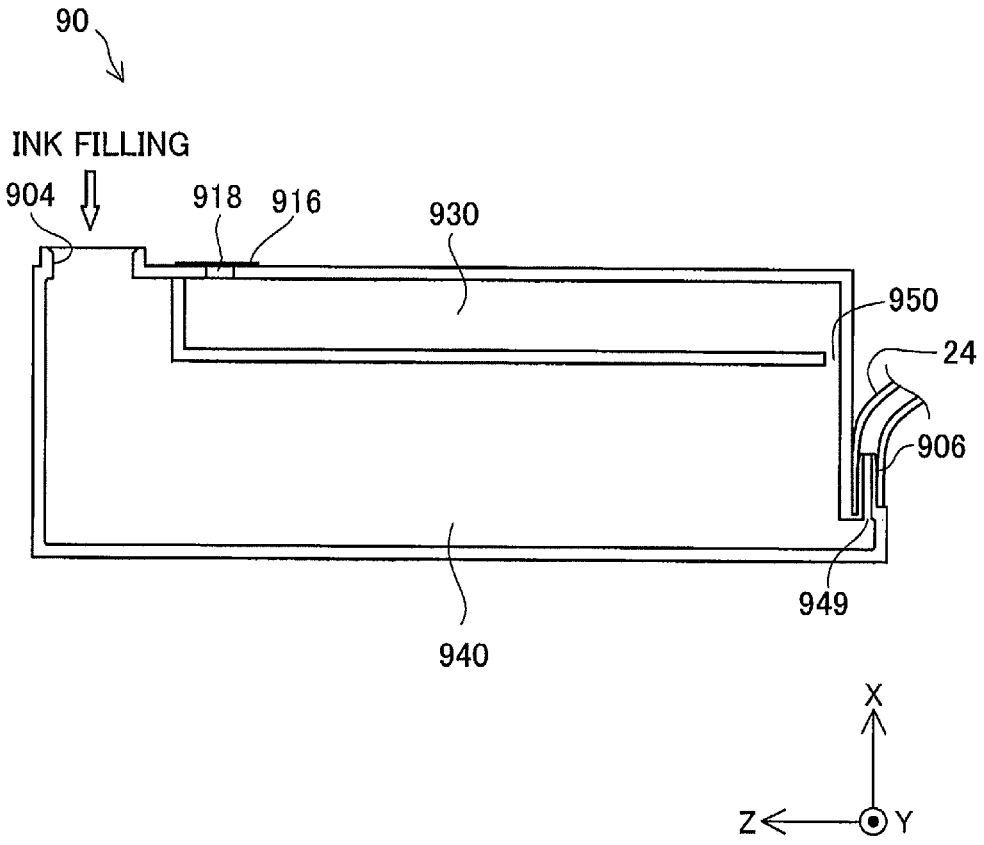
FIG. 1 is an explanatory diagram showing a first reference example.

In order to facilitate understanding of the embodiments, a first reference example is described prior to the embodiments. FIG. 1 is an explanatory diagram showing a liquid container 90 according to the first reference example. The XYZ axes mutually perpendicular to one another are indicated in FIG. 1 for specifying the directions. Some of the subsequent drawings also include similar indication of the XYZ axes according to the requirements. The liquid container 90 is also called ink tank 90. Ink is supplied from a liquid discharge port 906 of the ink tank 90 through a hose 24 serving as the flow pipe to a sub-tank (not shown) in a printer (liquid ejection apparatus). In the attitude (use attitude) of the ink tank 90 during supply of ink to the sub-tank, the negative direction of the Z axis is set to downward in the vertical direction.

The ink tank 90 includes a liquid chamber 940 and an air chamber 930. The liquid chamber 940 communicates with the air chamber 930 via a connection path 950. The liquid chamber 940 stores ink. The stored ink is supplied from a liquid outlet 949 (also called "one end 949 of the liquid discharge port 906") through the liquid discharge port 906 and the hose 24 to the sub-tank. During ink supply to the sub-tank, a liquid inlet 904 for ink filling is closed with a plug member (not shown).

As the ink in the liquid chamber 940 is consumed, the air is introduced from the air chamber 930 into the liquid chamber 940 via the connection path 950. The ink tank 90 has an open-air hole 918, through which the air chamber 930 is open to the atmosphere. A gas-liquid separation membrane 916 is provided at the open-air hole 918 to prevent leakage of ink.

During ink filling into the ink tank 90, the ink tank 90 is placed on a preset horizontal plane such as to set the negative direction of the X axis to downward in the vertical direction as shown in FIG. 1. The attitude of the ink tank 90 shown in FIG. 1 is called "filling attitude". In the ink tank 90 of the first reference example, the liquid inlet 904 is located at the higher position than the open-air hole 918 in the filling attitude. When the user fills ink through the liquid inlet 904 into the liquid chamber 940, there is a possibility that an excessive filling of ink overflows from the open-air hole 918. The user generally pays attention to the liquid inlet 904 during ink filling and may be unaware of the overflow of ink from the open-air hole 918.

In the structure of the first reference example, the gas-liquid separation membrane (also called "gas-liquid separation sheet") 916 provided to isolate the open-air hole 918 from the outside may be wetted with the ink overflowed from the open-air hole 918. Wetting the gas-liquid separation membrane 916 with ink may impair the function of the gas-liquid separation membrane 916. This may cause ink to permeate the gas-liquid separation membrane 916 and to be leaked outside. This may also prevent the air from permeating the gas-liquid separation membrane 916 and from being introduced into the ink tank 90.

Figure 2A:
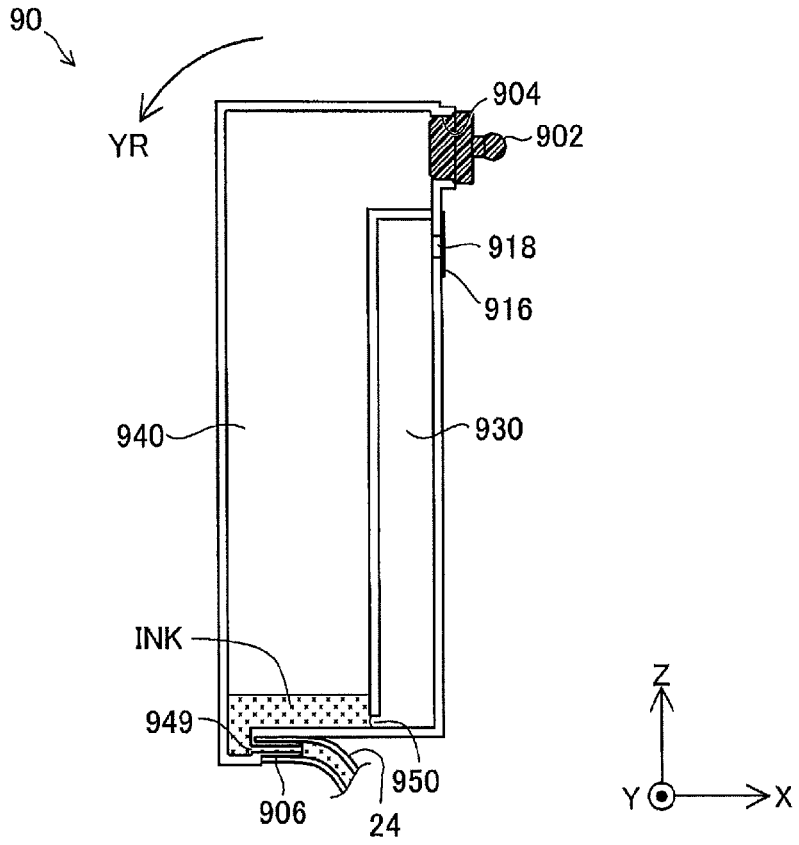
FIGS. 2A and 2B are explanatory diagrams showing a second reference example.
Figure 2B:
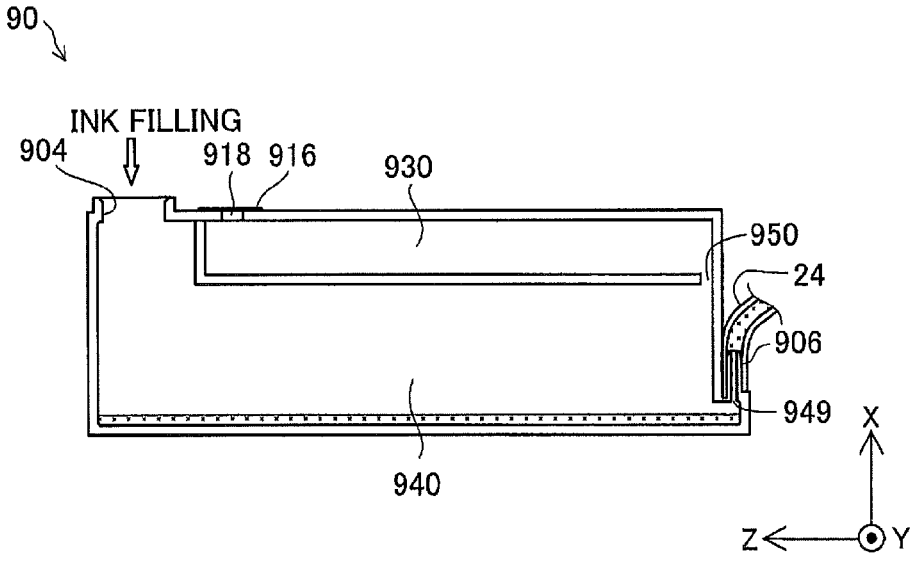

In order to further facilitate understanding of the embodiments, a second reference example is described. FIGS. 2A and 2B are explanatory diagrams showing a liquid container (ink tank) 90 according to the second reference example. FIG. 2A illustrates the inside of the liquid container 90 in the use attitude in which ink is supplied from the liquid container 90 to the printer as the liquid ejection apparatus. FIG. 2B illustrates the inside of the liquid container 90 in the filling attitude in which ink is filled into the liquid container 90. The structure of the ink tank 90 of the second reference example is substantially the same as that of the ink tank 90 of the first reference example and is thus not specifically explained here. FIG. 2A shows a plug member 902 to close the liquid inlet 904.

Referring to FIG. 2A, as the ink in the liquid chamber 940 is consumed, the air is introduced from the air chamber 930 into the liquid chamber 940 via the connection path 950. When there is a small residual amount of ink in the liquid chamber 940, the ink tank 90 is rotated to face the liquid inlet 904 upward in the vertical direction as shown by arrow YR. This changes the attitude of the ink tank 90 from the use attitude to the filling attitude.

Referring to FIG. 2B, when the attitude of the ink tank 90 containing a small residual amount of ink is changed from the use attitude to the filling attitude, the liquid level in the liquid chamber 940 may be located below the end 949. When ink is filled through the liquid inlet 904 into the liquid chamber 940 in this state, the air may flow through the liquid discharge port 906 and the hose 24 to a printer head.

B. Embodiments

B-1. First Embodiment

B-1-1. Structure of Liquid Ejection System

Figure 3A:
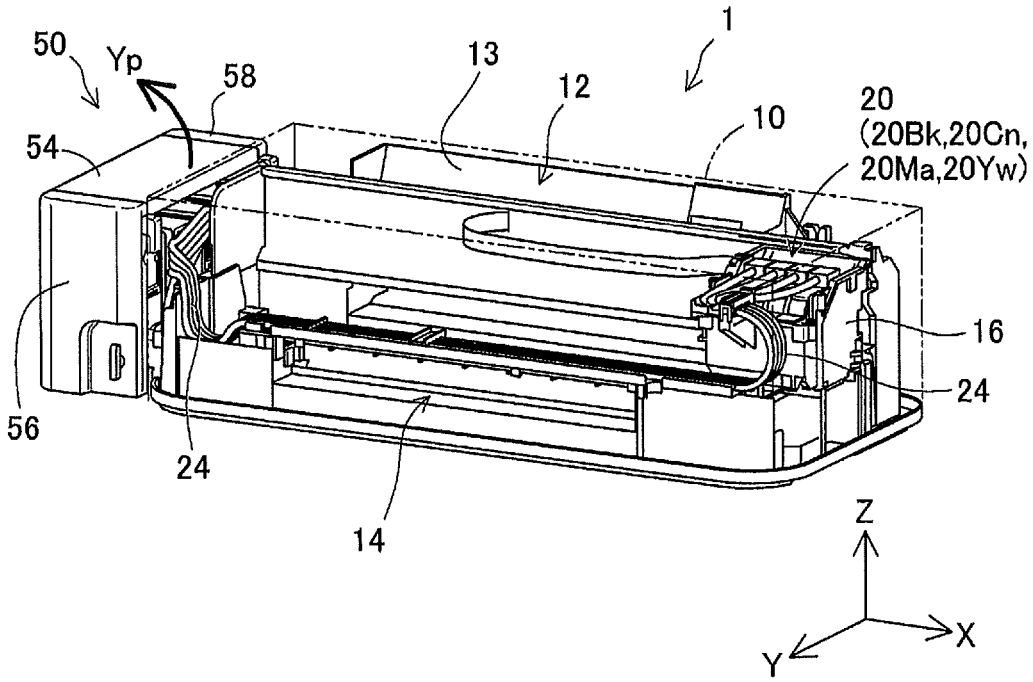
FIGS. 3A and 3B are explanatory diagrams showing a liquid ejection system 1 according to a first embodiment.
Figure 3B:
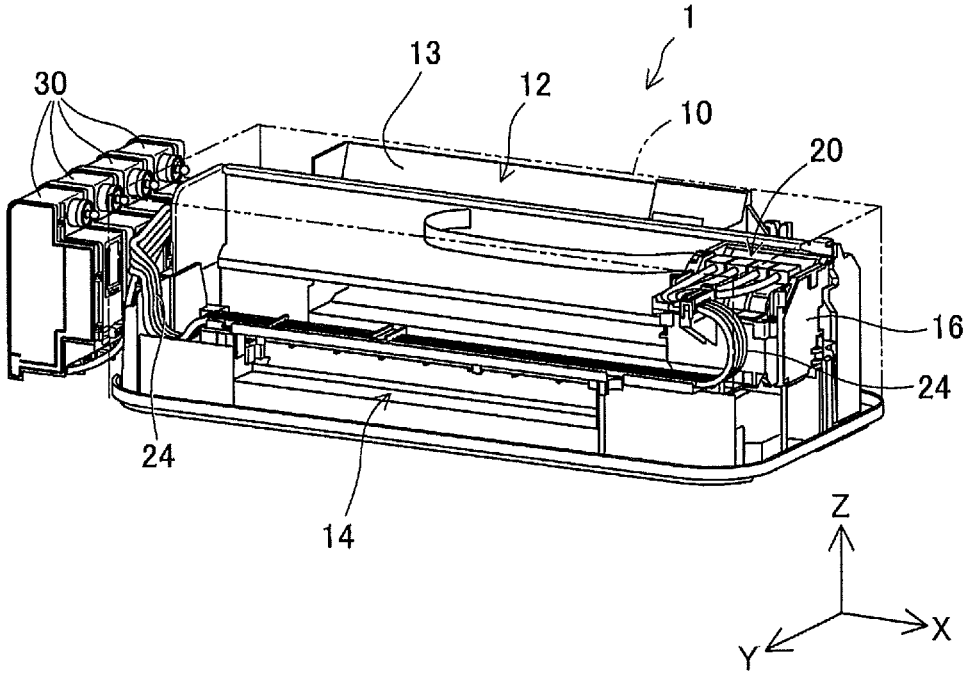

FIGS. 3A and 3B are explanatory diagrams showing a liquid ejection system 1 according to a first embodiment. FIG. 3A is a perspective view showing the appearance of the liquid ejection system 1. FIG. 3B is a perspective view showing the appearance of the liquid ejection system 1 with liquid containers 30 according to the first embodiment.

Referring to FIG. 3A, the liquid ejection system 1 includes an inkjet printer 12 (also called "printer 12") as a liquid ejection apparatus and a tank unit 50. The printer 12 includes a sheet feed assembly 13, a sheet discharge assembly 14, a carriage 16 and four sub-tanks 20. The four sub-tanks 20 respectively store different color inks. More specifically, the four sub-tanks 20 include a sub-tank 20Bk for storing black ink, sub-tank 20Cn for storing cyan ink, a sub-tank 20Ma for storing magenta ink and a sub-tank 20Yw for storing yellow ink. The four sub-tanks 20 are mounted on the carriage 16.

A print sheet set on the sheet feed assembly 13 is fed into the printer 12 to be subjected to printing and is discharged from the sheet discharge assembly 14.

The carriage 16 is movable in a main scanning direction (sheet width direction). The carriage 16 is moved via a timing belt (not shown) by driving a stepping motor (not shown). A recording head (not shown) is provided on the lower face of the carriage 16. During printing, the inks stored in the sub-tanks 20 are ejected from a plurality of nozzles provided on the recording head onto the print sheet. The respective parts of the printer 12, such as the timing belt and the carriage 16, are placed in a casing 10 to be protected.

The tank unit 50 has an upper casing 54, a first side casing 56, a second side casing 58 and a bottom casing (not shown). The casings 54, 56 and 58 and the bottom casing may be made of a synthetic resin, such as polypropylene (PP) or polystyrene (PS). In this embodiment, the casings 54, 56 and 58 and the bottom casing are made of polystyrene and are colored in a predetermined color (for example, black) to be opaque. As shown in FIG. 3B, the tank unit 50 further includes four ink tanks 30 as liquid containers surrounded by the casings (cover members) 54, 56 and 58 and the bottom casing (cover member). The tank unit 50 is stably placed on a predetermined location (for example, a horizontal plane of the desk or the shelf) by the casings 54, 56 and 58 and the bottom casing. As shown in FIG. 3A, the upper casing 54 may be opened and closed in the direction of arrow Yp about one side 54*a* as the pivot. The four ink tanks 30 thus respectively store inks corresponding to the color inks stored in the four sub-tanks 20. The four ink tanks 30 respectively store black ink, cyan ink, magenta ink and yellow ink. The ink tanks 30 have the greater capacities than the sub-tanks 20.

The ink tanks 30 storing the respective color inks are connected with the sub-tanks 20 storing the corresponding color inks by means of hoses 24. As the ink is ejected from the recording head and the ink in the sub-tank 20 is consumed, the ink is supplied from the ink tank 30 to the sub-tank 20 via the hose 24. The liquid ejection system 1 can thus continue printing with no interruption of the printer 12. The hoses 24 are made of a material having elasticity and flexibility, for example, synthetic rubber. One modified structure may omit the sub-tanks 20 and directly supply the respective inks from the ink tanks 30 to the recording head via the hoses 24.

Figure 4:
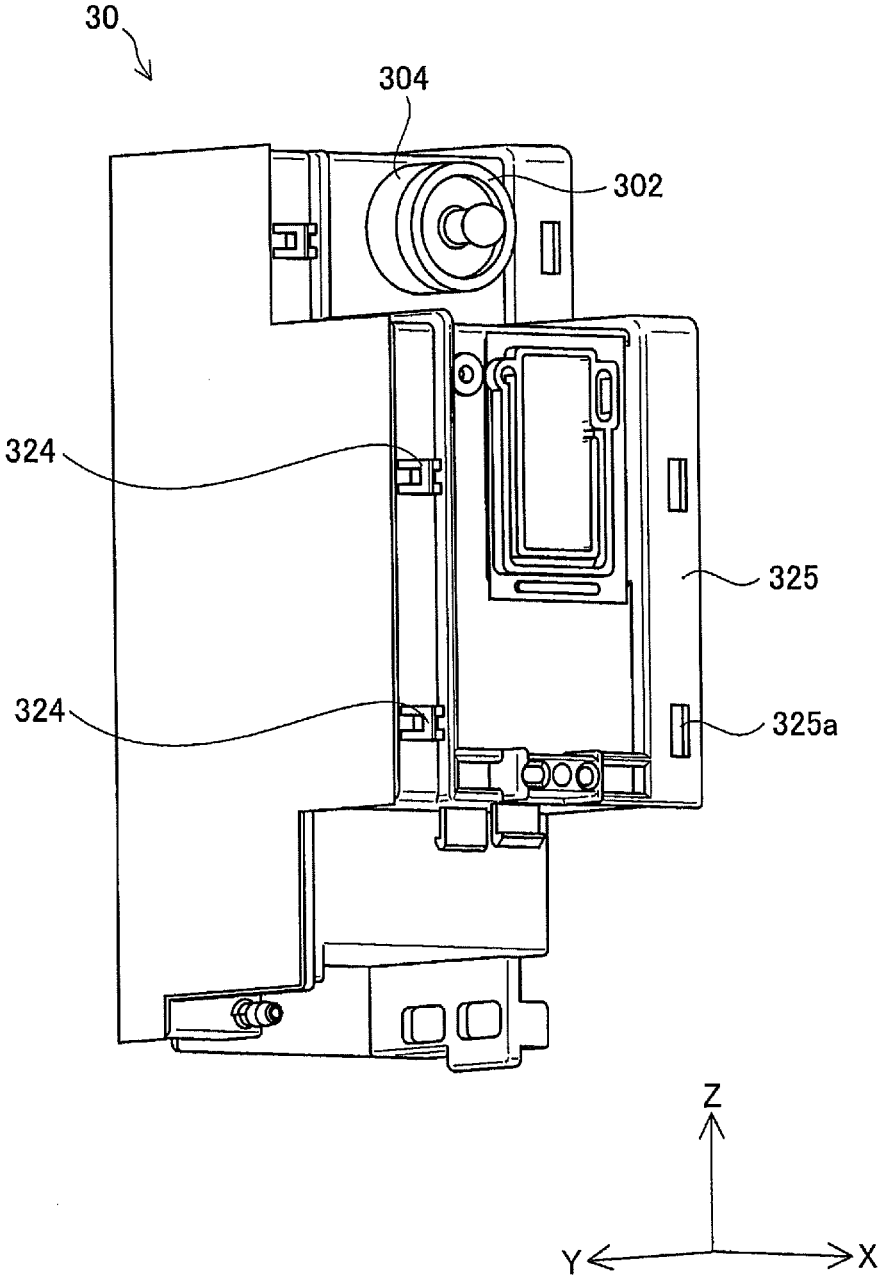
FIG. 4 is a perspective view showing the appearance of an ink tank 30.

FIG. 4 is a perspective view showing the appearance of the ink tank 30. The ink tank 30 has a plug member 302. The plug member 302 is set in a liquid inlet 304. The plug member 302 is detachable from the liquid inlet 304 to enable ink to be filled (refilled) through the liquid inlet 304 into the ink tank 30. The plug member 302 for closing the liquid inlet 304 of one ink tank 30 is coupled with the plug member 302 for closing the liquid inlet 304 of adjacent another ink tank 30 by means of a joining member, although not being specifically illustrated. In other words, two plug members 302 are integrated in a non-separable manner by means of the joining member. The ink tank 30 has first fitting elements 324 (also called "projections 324") and a second fitting element 325. The first fitting elements 324 are formed in convex form. The second fitting element 325 has through-holes (also called "apertures") 325*a*. The adjacent ink tanks 30 are coupled with each other by means of the first fitting elements 324 and the second fitting element 325.

Figure 5:
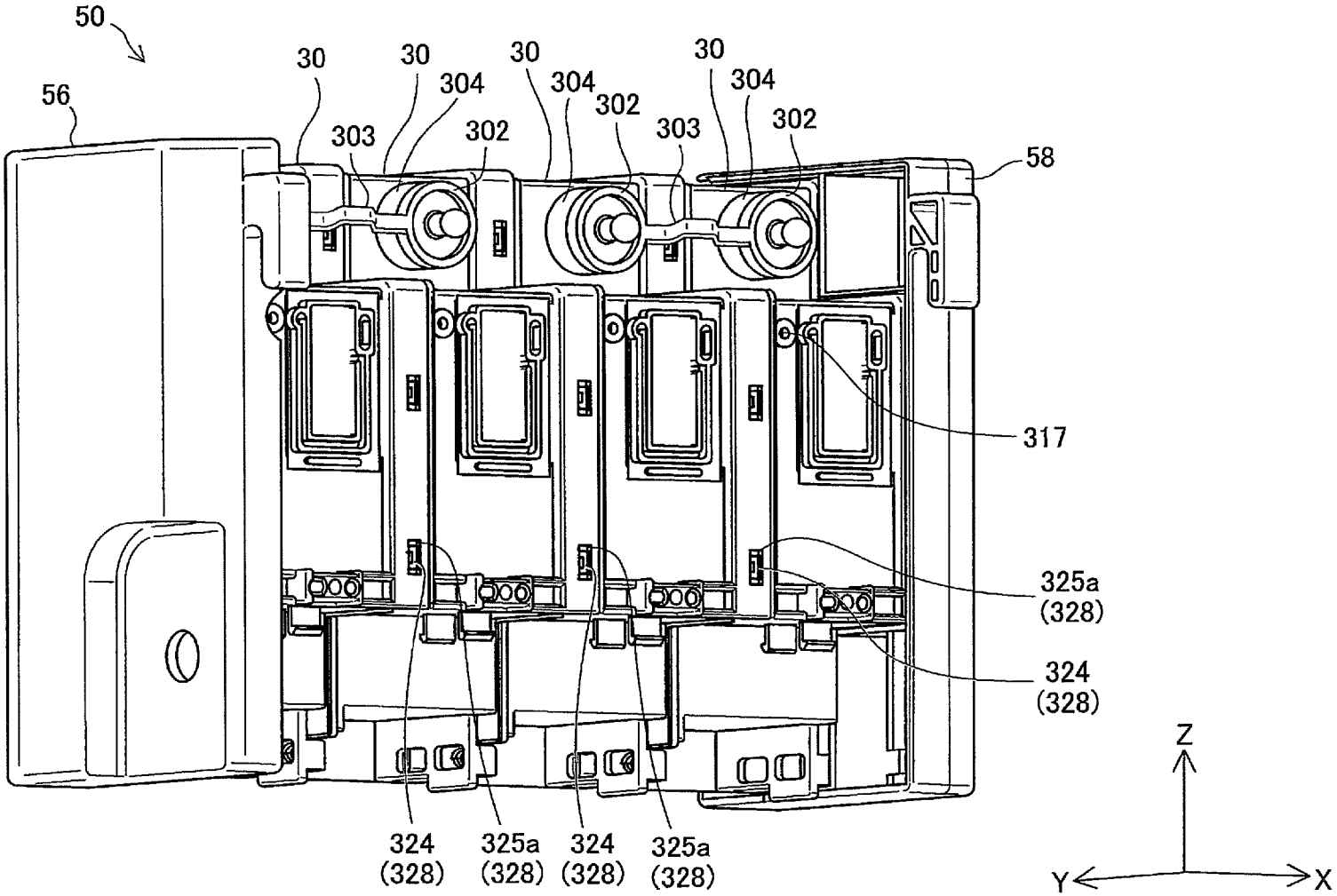
FIG. 5 is an explanatory diagram further showing the ink tank 30.

FIG. 5 is a perspective view showing the appearance of the tank unit 50. The upper casing 54 and the bottom casing are omitted from the illustration of FIG. 5. The tank unit 50 has the Z-axis direction set to the vertical direction in the use attitude for supplying ink to the printer 12, wherein the negative direction of the Z axis is set to downward in the vertical direction. Each of the ink tanks 30 has fitting units 328 for fastening and integrating the ink tank 30 to and with adjacent ink tanks 30. Each fitting unit 328 includes the aperture 325*a* and the projection 324 explained above. Adjacent ink tanks 30 are assembled and integrated by fitting the projections 324 of one ink tank 30 into the apertures 325*a* of adjacent another ink tank 30. The projections 324 may be released from the apertures 325*a* by external force, so that the assembled ink tanks 30 are readily disassembled. The number of ink tanks 30 included (stacked) in the tank unit 50 is readily changeable according to the number of different ink colors used for the printer 12 and the specifications of the printer 12. This structure of the tank unit 50 enables the user to readily add a new ink tank 30 or detach any of the ink tanks 30 by means of the fitting units 328.

The ink tank 30 includes the liquid inlet 304 provided to fill (refill) ink into the ink tank 30, and the plug member 302 provided to close the liquid inlet 304. The liquid inlet 304 is formed in cylindrical shape and is connected with a liquid chamber as discussed later. The plug member 302 is detachably attached to the liquid inlet 304. As mentioned above, two plug members 302 attached to adjacent ink tanks 30 are coupled with each other by means of a joining member 303. The two plug members 302 are thus integrated in a non-separable manner by means of the joining member 303.

The liquid inlet 304 is provided to be open to the horizontal direction (i.e., the positive direction of the X axis in the illustrated embodiment) in the use attitude of the ink tank 30. This configuration will be described later in detail.

The ink tank 30 also has an air inlet 317. The air inlet 317 is provided at one of the two ends of an open-air flow path (discussed later) and is used to introduce the outside air into the ink tank 30. While ink is supplied from a liquid discharge port (not shown) through a hose into the printer 12, the outside air is introduced into the ink tank 30 via the air inlet 317.

B-1-2. General Structure of Ink Tank 30

Figure 6:
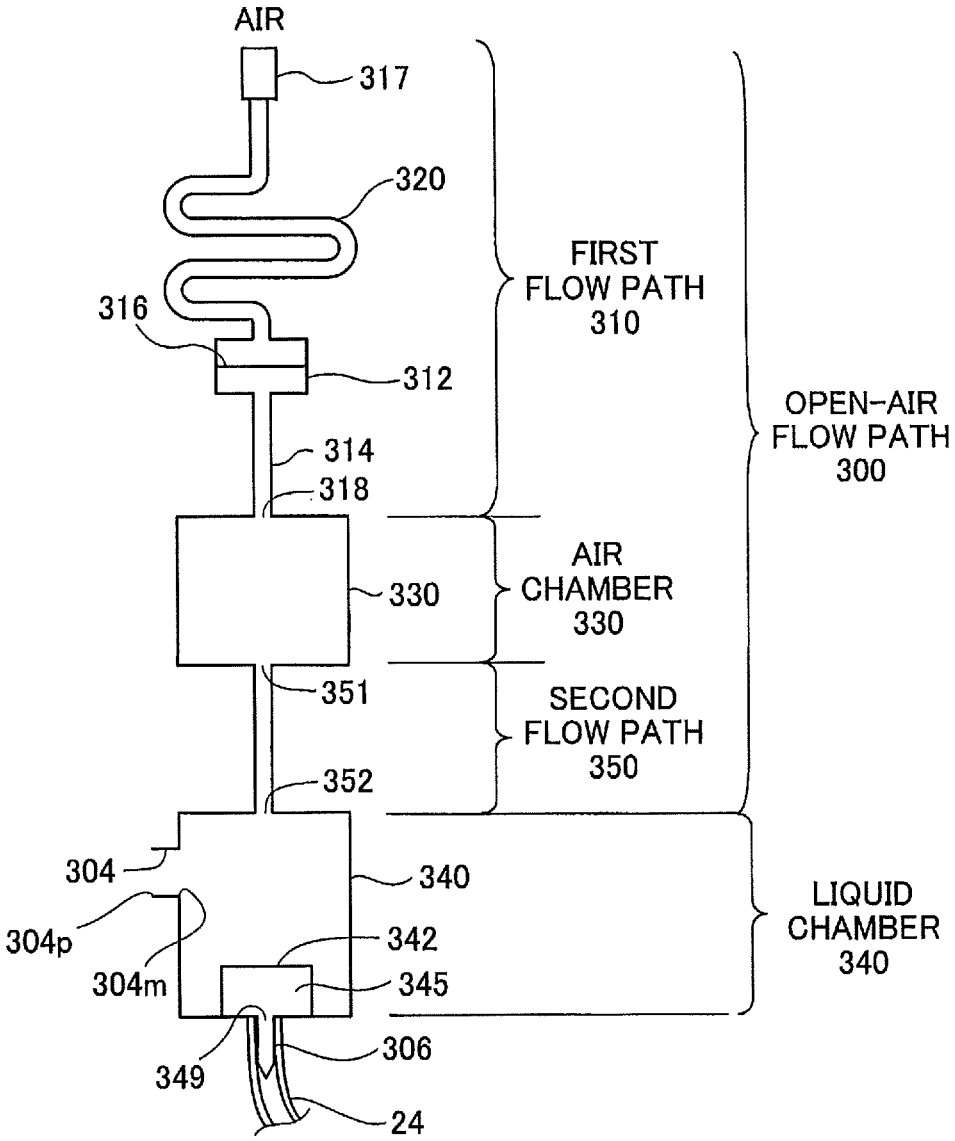
FIG. 6 conceptually illustrates the pathway from an air inlet 317 to a liquid discharge port 306.

For the better understanding, prior to description of the detailed structure of the ink tank 30, the pathway from the air inlet 317 to a liquid discharge port 306 is conceptually described with reference to FIG. 6. FIG. 6 conceptually illustrates the pathway from the air inlet 317 to the liquid discharge port 306.

The pathway from the air inlet 317 to the liquid discharge port 306 is roughly divided into an open-air flow path 300 and a liquid chamber 340. The open-air flow path 300 includes a first flow path 310, an air chamber 330 and a second flow path 350 (also called connection path 350) sequentially arranged from upstream to downstream.

The first flow path 310 has an open-air hole 318 at one end open to the air chamber 330 and the air inlet 317 at the other end open to the outside, so as to connect the air chamber 330 to the outside. The first flow path 310 includes a connecting flow path 320, a gas-liquid separation chamber 312 and a connecting flow path 314. The connecting flow path 320 has one end connecting with the air inlet 317 and the other end connecting with the gas-liquid separation chamber 312. Part of the connecting flow path 320 forms an elongated flow path to prevent the moisture of ink accumulated in the liquid chamber 340 from diffusing and evaporating from the open-air flow path 300. A sheet member (film member) 316 is disposed between the upward portion and the downward portion of the gas-liquid separation chamber 312. This sheet member 316 has gas permeability and liquid impermeability. Providing this sheet member 316 in the midst of the open-air flow path 300 prevents the backflow of ink from the liquid chamber 340 from flowing into the upstream of the sheet member 316. The sheet member 316 wetted with ink may impair its original function as the gas-liquid separation membrane. More specifically, the sheet member 316 wetted with ink may impair the air permeability. In this case, the air may not be introduced into the ink tank 30.

The connecting flow path 314 connects the gas-liquid separation chamber 312 with the air chamber 330. One end of the connecting flow path 314 forms the open-air hole 318.

The air chamber 330 has the greater flow path cross-sectional area than the second flow path 350 (described later) and has a preset volume. This structure accumulates the back flow of ink from the liquid chamber 340 and prevents the ink from flowing into the upstream of the air chamber 330. The air chamber 330 accumulates a certain amount of the back-flow ink when the air in the liquid chamber 340 is expanded due to, for example, a temperature change and causes the back flow of ink via the second flow path 350. Providing the air chamber 330 in the ink tank 30 lowers the potential that ink is leaked out of the air inlet 317 even in the event of back flow of ink.

The second flow path 350 has an airside opening 351 at one end open to the air chamber 330 and a liquid-side opening 352 at the other end open to the liquid chamber 340 and thereby connects the air chamber 330 with the liquid chamber 340. The second flow path 350 has the sufficiently small flow path cross-sectional area to form the meniscus (liquid bridging).

The liquid chamber 340 stores ink and is designed to supply ink through a liquid outlet 349 of the liquid discharge port 306 into the sub-tank 20 (FIG. 3) via the hose 24. The liquid chamber 340 has a liquid retainer 345. The liquid retainer 345 has a partition wall member 342 in the form of a rib. The partition wall member 342 blocks the flow of ink in a predetermined direction in the liquid chamber 340, so as to prevent ink from flowing out of the liquid retainer 345 to the remaining part of the liquid chamber 340. The liquid chamber 340 also has the liquid inlet 304 as explained above. An upper end 304*p* at one end of the liquid inlet 304 is open to the outside, while a lower end 304*m* at the other end of the liquid inlet 304 is open to the liquid chamber 340.

Figure 7:
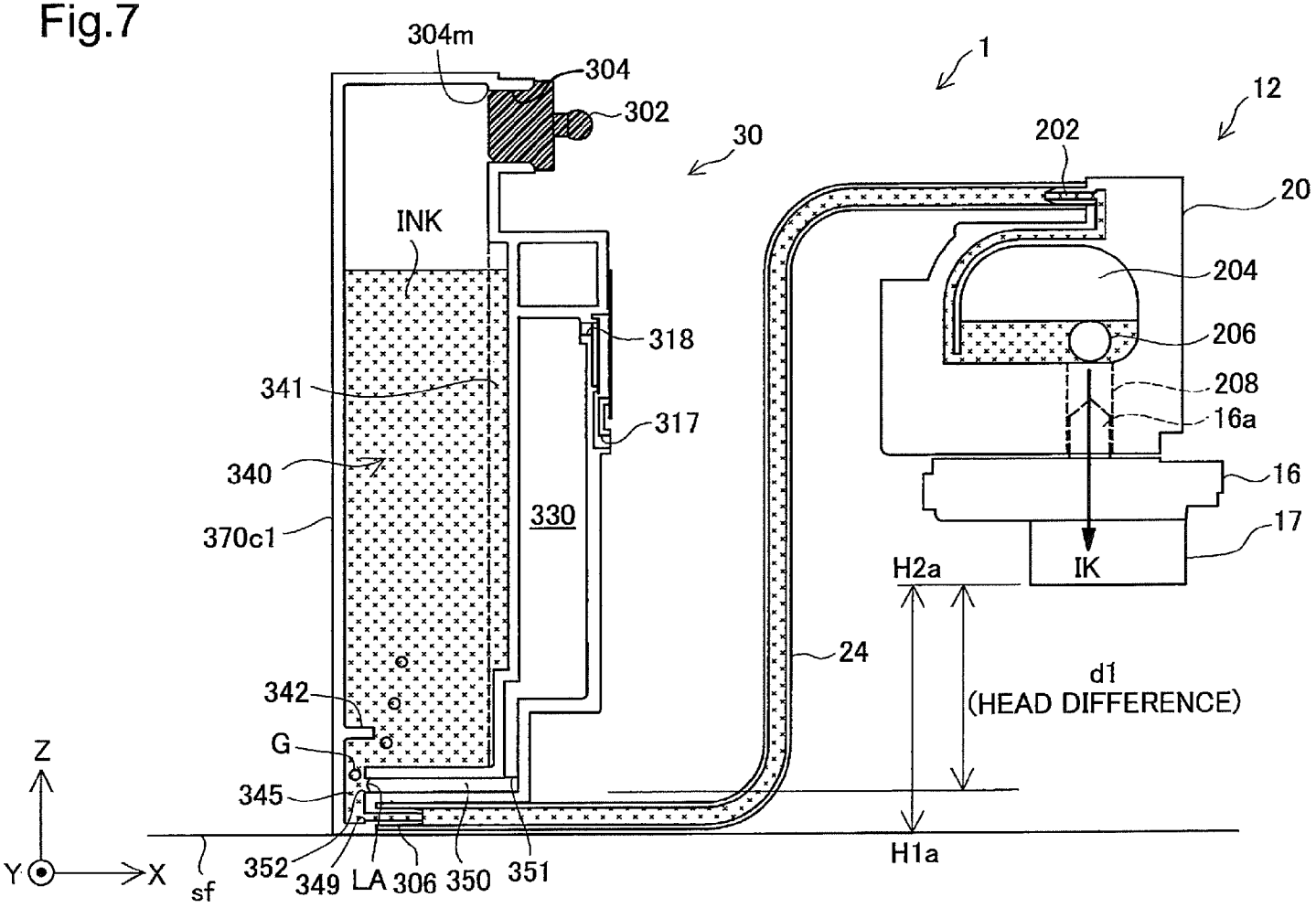
FIG. 7 is an explanatory diagram showing ink supply.

For the better understanding, the principle of supplying ink from the ink tank 30 to the sub-tank 20 is described with reference to FIG. 7. FIG. 7 is an explanatory diagram showing ink supply from the ink tank 30 to the sub-tank 20. The insides of the ink tank 30, the hose 24 and the printer 12 are schematically shown in FIG. 7. The liquid ejection system 1 is located on a preset horizontal surface sf (also called "mounting surface sf"). The liquid discharge port 306 of the ink tank 30 is connected with a liquid receiving port 202 of the sub-tank 20 via the hose 24. The sub-tank 20 is made of a synthetic resin, such as polystyrene or polyethylene. The sub-tank 20 includes an ink reserving chamber 204, an ink fluid path 208 and a filter 206. An ink supply needle 16*a* of a carriage 16 is inserted into the ink fluid path 208. When some impurity, such as foreign material, is contained in ink, the filter 206 traps the impurity and prevents the impurity from flowing into a recording head 17. Ink in the ink reserving chamber 204 is flowed through the ink fluid path 208 and the ink supply needle 16*a* by suction from the recording head 17 and is supplied to the recording head 17. The ink supplied to the recording head 17 is ejected to the outside (print sheet) via the nozzles.

The liquid chamber 340 has the partition wall member 342 extended by a predetermined length from the inner surface of a first wall member 370*c*1 inward the liquid chamber 340. The partition wall member 342 is formed over the entire length in the Y-axis direction (width direction) in the liquid chamber 340. In other words, the partition wall member 342 parts the first wall member 370*c*1 into two regions. One of the two parted regions connecting with the liquid discharge port 306 is called the liquid retainer 345. The liquid chamber 340 also has a specific space 341. The specific space 341 is a concave formed by the wall member of the liquid chamber 340 and is open downward in the vertical direction (i.e., in the negative direction of the X axis) in the filling attitude of the ink tank 30. In the filling attitude of the ink tank 30, the specific space 341 is located above (i.e., on the side of the positive direction of the X axis) the lower end 304*m* of the liquid inlet 304. For the better understanding, the boundary between the specific space 341 and the remaining region of the liquid chamber 340 is shown by the broken line.

The liquid inlet 304 has a cylindrical internal flow path connecting with the liquid chamber 340. More specifically, the upper end 304*p* at one end of the liquid inlet 304 is open to the outside, while the lower end 304*m* at the other end is open to the liquid chamber 340. The plug member 302 is detachably attached to the liquid inlet 304 to prevent ink from leaking out through the liquid inlet 304. In the use attitude of the ink tank 30, the liquid inlet 304 is open toward the direction orthogonal to the vertical direction (Z-axis direction) (i.e., horizontal direction or positive direction of the X axis in FIG. 7).

The liquid outlet 349 at one end of the liquid discharge port 306 is connected to the liquid chamber 340. In other words, the liquid outlet 349 is open to the liquid chamber 340. The liquid outlet 349 is located below (i.e., on the side of the negative direction of the X axis) the specific space 341 in the filling attitude of the ink tank.

After the ink is filled through the liquid inlet 304 into the liquid chamber 340 in the filling attitude, sealing the liquid inlet 304 with the plug member 302 and changing the attitude of the ink tank to the use attitude cause the air inside the liquid chamber 340 to be expanded and maintain the negative pressure in the liquid chamber 340. The air chamber 330 is, on the other hand, connected with the open-air hole 318 and maintains the atmospheric pressure.

In the use attitude, the second flow path 350 forming the meniscus and retaining ink is located below the lower end 304*m* of the liquid inlet 304. In this embodiment, the second flow path 350 is located near the lower end of the ink tank 30 in the use attitude. Even when the liquid level in the liquid chamber 340 is lowered with consumption of ink in the liquid chamber 340, this structure enables the ink level directly exposed to the atmosphere (atmosphere-exposed liquid level) LA to be kept at a fixed height for a long time period (i.e., a time period until the ink level is lowered to or below the ink refill level). In the use attitude, the other end 352 forming the meniscus is disposed at the lower position than the recording head 17. This causes a head difference d1. The head difference d1 in the state that the meniscus is formed at the other end 352 in the use attitude is also called "stationary head difference d1".

Suction of the ink in the ink reserving chamber 204 by the recording head 17 causes the pressure of the ink reserving chamber 204 to be not less than a preset negative pressure. When the pressure of the ink reserving chamber 204 is not less than the preset negative pressure, the ink in the liquid chamber 340 is supplied via the hose 24 to the ink reserving chamber 204. The amount of ink corresponding to the amount supplied to the recording head 17 is automatically refilled from the liquid chamber 340 into the ink reserving chamber 204. In other words, when the suction force (negative pressure) from the printer 12 becomes greater by a certain amount than the head difference d1 caused by the height difference in the vertical direction between the ink level exposed to the air chamber 330 in the ink tank 30 (i.e., atmosphere-exposed liquid level LA) and the recording head (more specifically, the nozzles), ink is supplied from the liquid chamber 340 to the ink reserving chamber 204. In order to supply ink stably from the ink tank 30 to the recording head 17, it is required that the atmosphere-exposed liquid level LA is located at the height equal to or lower than, but not extremely lower than, the height of the recording head 17. When the atmosphere-exposed liquid level LA is located at the higher position than the recording head 17, an excess amount of ink is supplied from the ink tank 30 to the printer 12 and may be leaked out of the recording head 17. When the atmosphere-exposed liquid level LA is located at the extremely lower position than the recording head 17, on the other hand, the suction force of the recording head 17 may be not sufficient to suck the ink from the ink tank 30 into the printer 12. This embodiment specifies the position of the atmosphere-exposed liquid level LA in a height range of H1*a* to H2*a*, as the condition for stably supplying ink from the ink tank 30 to the printer 12.

As the ink in the liquid chamber 340 is consumed, the air G (also called "air bubbles G") in the air chamber 330 is introduced through the connection path 350 to the liquid chamber 340. This lowers the liquid level in the liquid chamber 340. The meniscus directly exposed to the atmosphere (atmosphere-exposed liquid level LA) is formed in the second flow path 350. This maintains the head difference d1, even when the liquid level in the liquid chamber 340 is lowered. The ink can thus be stably supplied from the ink tank 30 to the recording head 17 by certain suction force of the recording head 17.

B-1-3. Detailed Structure of Ink Tank 30

Figure 8:
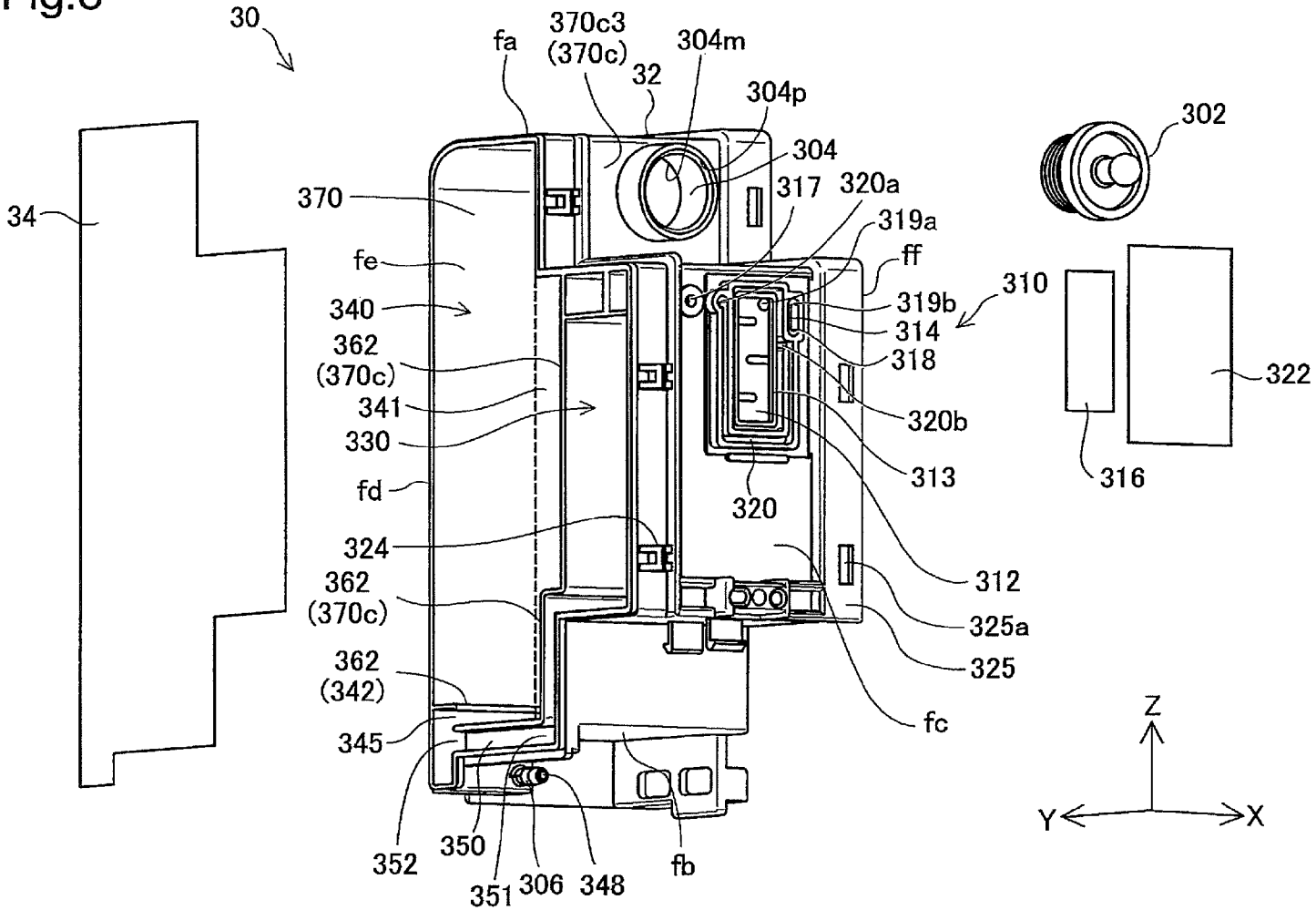
FIG. 8 is an exploded perspective view of the ink tank 30.
Figure 9:
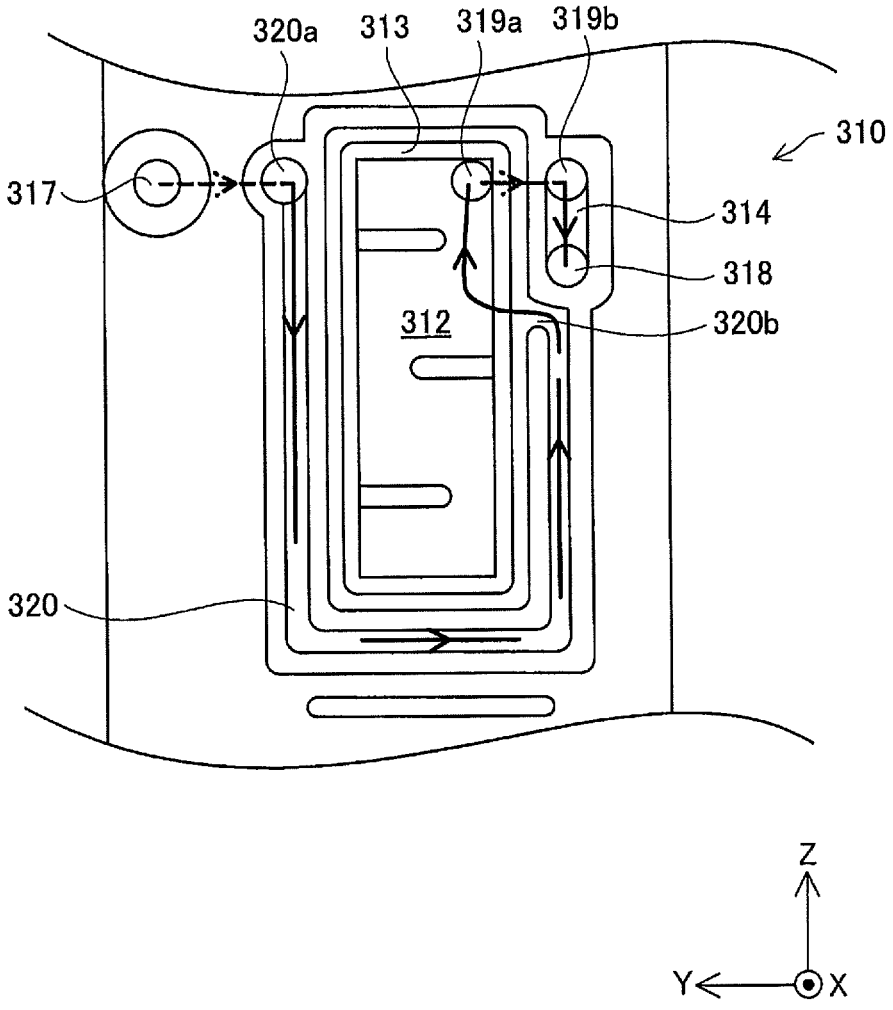
FIG. 9 is an explanatory diagram showing the flow of the air.
Figure 10:
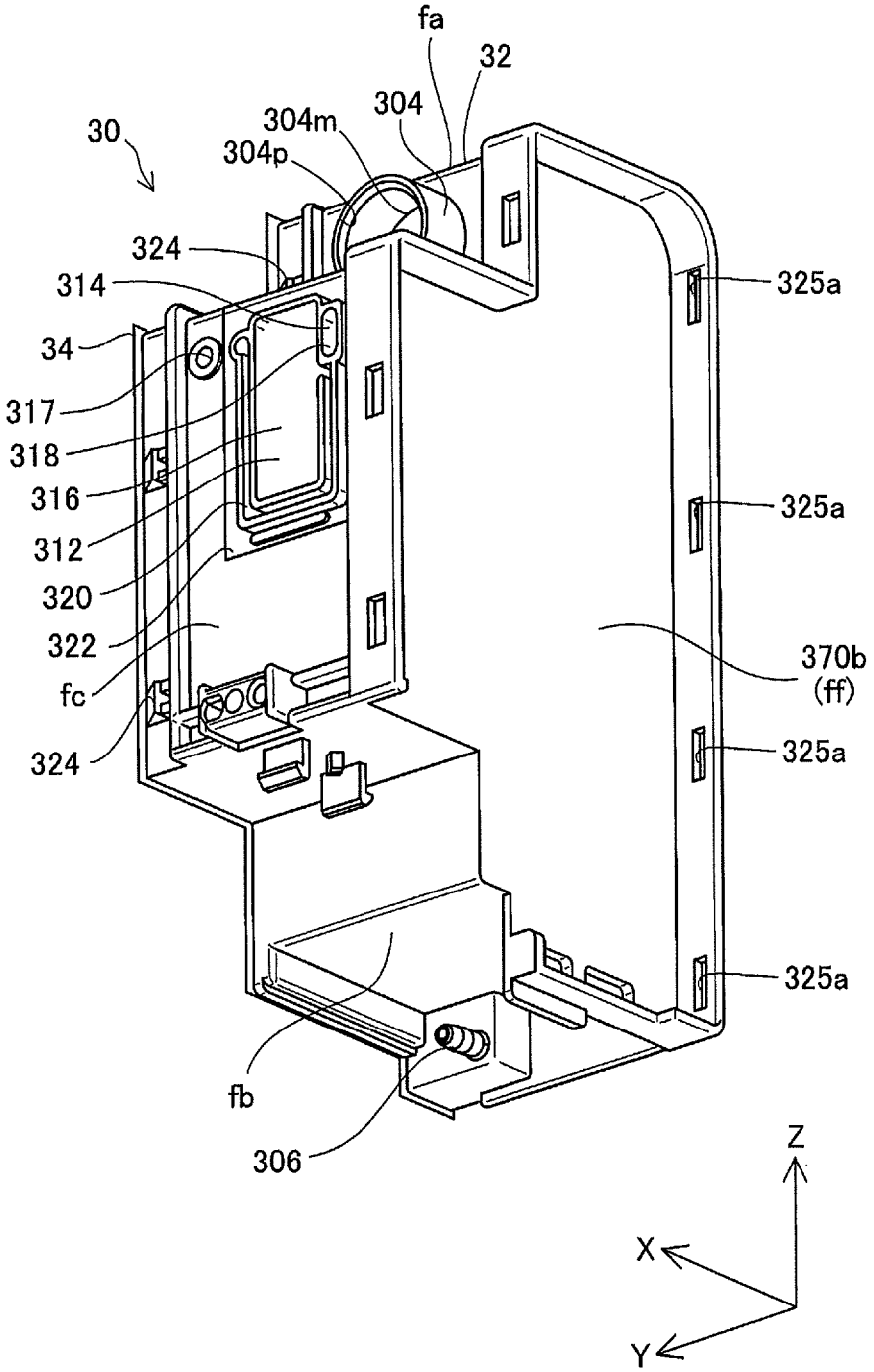
FIG. 10 is a perspective view showing the appearance of the ink tank 30.

The detailed structure of the ink tank 30 is described with reference to FIGS. 8 to 10. FIG. 8 is an exploded perspective view of the ink tank 30. FIG. 9 is an explanatory diagram showing the flow of the air. FIG. 10 is a perspective view showing the appearance of the ink tank 30. The joining member 303 (FIG. 5) for the plug member 302 is omitted from the illustration of FIG. 8. FIG. 9 shows the flow of the air from the air inlet 317 to the open-air hole 318. FIG. 9 is the view of FIG. 8 seen from the side of the positive direction of the X axis and schematically shows the flow of the air from the air inlet 317 to the open-air hole 318 by the arrows. Sheet members 316 and 322 are omitted from the illustration of FIG. 9. The plug member 302 is omitted from the illustration of FIG. 10.

As shown in FIGS. 8 and 10, the ink tank 30 is formed in columnar shape (more specifically, rectangular columnar shape). Referring to FIG. 8, the ink tank 30 has a tank main body 32, the plug member 302 and a plurality of sheet members 34, 316 and 322 (also called "films 34, 316 and 322"). The film 34 may be called first film 34 and the film 322 may be called second film 322. The tank main body 32 is made of a synthetic resin, such as polypropylene and is translucent. This structure facilitates the user to visually check the state of ink (amount of ink and ink level) inside the tank main body 32 from the outside. The tank main body 32 is formed in a concave shape including one side face having an opening. Ribs (wall members) 362 in various shapes are provided in the concave of the tank main body 32. The side face having an opening (i.e., side face including the outer frame of the tank main body 32 to form an opening) is called open side face 370 (or open wall member 370). For the convenience of explanation, a face of the tank main body 32 on the side of the positive direction of the Z axis is called upper face fa, and a face on the side of the negative direction of the Z axis is bottom face fb. Among four side faces of the tank main body 32 in the use attitude, the face on the side of the positive direction of the X axis is called right side face fc, the face on the side of the negative direction of the X axis is called left side face fd, the face on the side of the positive direction of the Y axis (i.e., the face having an opening) is called front face fe, and the face on the side of the negative direction of the Y axis is called rear face ff.

The first film 34 is made of a synthetic resin, such as polypropylene, and is transparent. The first film 34 is thermally welded to the tank main body 32 to cover the opening of the open side face 370. More specifically, the first film 34 is closely and tightly attached to the end faces of the ribs 362 and the end face of the outer frame of the tank main body 32. This forms a plurality of small chambers, i.e., the air chamber 330, the liquid chamber 340 including the liquid retainer 345 and the second flow path 350 (connection path 350). In other words, the tank main body 32 and the first film 34 define the air chamber 330, the liquid chamber 340 and the second flow path 350. The means for attaching the first film 34 to the tank main body 32 is not limited to thermal welding but may be applying an adhesive. The details of the respective chambers (structures) will be discussed later.

The liquid inlet 304 is provided on the right side face fc of the tank main body 32. The gas-liquid separation chamber 312, the air inlet 317, the connecting flow paths 314 and 320 and connection holes 318, 319*a* and 319*b* are also provided on the right side face fc. The gas-liquid separation chamber 312 is formed in a concave shape. The connection hole 319*a* is formed in the bottom face of the concave. The connection hole 318 is also called the open-air hole 318 and connects with the air chamber 330 to introduce the outside air into the air chamber 330.

A dike 313 is formed along the entire circumference of the inner wall surrounding the bottom face of the gas-liquid separation chamber 312. The sheet member 316 is bonded to the dike 313. This sheet member 316 has gas permeability and liquid impermeability. The film 322 is bonded to the right side face fc to cover the connecting flow path 320, the gas-liquid separation chamber 312, the connecting flow path 314 and the connection holes 318, 319*a* and 319*b*. This defines the connecting flow paths 314 and 320 and prevents the ink in the ink tank 30 from leaking out of the ink tank 30.

The plug member 302 is an elastic member (for example, rubber) and is detachable from the liquid inlet 304 by external force. Detaching the plug member 302 from the liquid inlet 304 enables ink to be filled (refilled) through the liquid inlet 304 into the liquid chamber 340. The air chamber 330 is connected with the liquid chamber 340 by the connection path 350. More specifically, one end 351 of the connection path 350 communicates with the air chamber 330, while the other end 352 communicates with the liquid chamber 340 (more specifically, the liquid retainer 345). In other words, one end 351 is open to the air chamber 330, while the other end 352 is open to the liquid chamber 340.

The further details of the liquid inlet 304 are described. The liquid inlet 304 is provided in an airside wall member 370*c*3 to have the upper end 304*p* open in the horizontal direction (i.e., positive direction of the X axis) in the use attitude of the ink tank 30 and open upward in the vertical direction (i.e., positive direction of the X axis) in the filling attitude of the ink tank 30. The air-side wall member 370*c*3 is a vertically-angled wall member relative to the mounting surface on which the ink tank is located (i.e., the horizontal surface defined by the X axis and the Y axis) in the use attitude of the ink tank 30. In other words, the airside wall member 370*c*3 is extended toward the upper side from the lower side in the use attitude of the ink tank 30. In this embodiment, in the use attitude of the ink tank, the air-side wall member 370*c*3 forms part of the wall of the ink tank 30 at substantially right angle to the mounting surface. The air-side wall member 370*c*3 is one of plurality of wall members defining the liquid chamber 340 as described later. In the use attitude of the ink tank 30, wall members (vertically-angled wall members) forming the side face of the liquid chamber 340 are vertically-angled relative to the mounting surface. The air-side wall member 370*c*3 is disposed close to the air chamber 330 among the plurality of vertically-angled wall members. In general, when the user fills ink through the liquid inlet 304 into the liquid chamber 340, disposing the upper end 304*p* of the liquid inlet 304 to be open upward in the vertical direction facilitates the ink filling into the liquid chamber 340. Providing the liquid inlet 304 in the airside wall member 370*c*3 as described above urges the user to change the attitude of the ink tank 30 to the filling attitude during ink filling. Providing the liquid inlet 304 in the airside wall member 370*c*3 also facilitates formation of the liquid inlet 304 in such a manner that urges the user to change the attitude of the ink tank 30 to the filling attitude during ink filling. The "upper end 304*p* open in the horizontal direction" means the angle between the flat paper in contact with the upper end 304*p* in the use attitude and the horizontal direction in a range of greater than 45 degrees but not greater than 90 degrees. The "upper end 304*p* open upward in the vertical direction", on the other hand, means the angle between the flat paper in contact with the upper end 304*p* in the use attitude and the vertical direction in a range of greater than 45 degrees but not greater than 90 degrees.

The liquid discharge port 306 is provided close to the lower-most end (i.e., bottom face fb) of the tank main body 32 in the use attitude. The liquid discharge port 306 is cylindrical and forms an internal flow path. One end (not shown) of the liquid discharge port 306 communicates with the liquid chamber 340, while the other end 348 is open to the outside. The hose 24 (FIG. 3) is attached to the liquid discharge port 306.

The liquid chamber 340 is defined by a plurality of wall members. The plurality of wall members mainly include the open wall member 370, an opposed wall member 370*b* (FIG. 10) and connecting wall members 370*c* (FIG. 8). Among the plurality of wall members, the open wall member 370, the opposed wall member 370*b*, the wall member forming the bottom face fb and the airside wall member 370*c*3 are vertically-angled manner in the use attitude. The open wall member 370 is formed by attaching the first film 34 to the tank main body 32. The opposed wall member 370*b* is opposite to the open wall member 370 across the inner space (for example, the liquid chamber 340). The plurality of connecting wall members 370*c* are connected with the open wall member 370 and with the opposed wall member 370*b*. As shown in FIGS. 8 and 10, the outer shape of the open wall member 370 is identical (convex shape) with the outer shape of the opposed wall member 370*b*.

Referring to FIG. 9, the air inlet 317 and the connecting flow path 320 connect with each other via one end 320*a* of the connecting flow path 320 and the internal flow path formed inside the tank main body 32. The connecting flow path 320 connects with the gas-liquid separation chamber 312 via the other end 320*b*. The connecting flow path 320 is formed along the outer circumference of the gas-liquid separation chamber 312 to extend the distance from the air inlet 317 to the gas-liquid separation chamber 312. This structure prevents the moisture of the ink inside the tank main body 32 from evaporating from the air inlet 317 to the outside. In order to extend the connecting path 320 and prevent evaporation of the moisture, the connecting flow path 320 may be provided in a serpentine manner.

The air flowing through the other end 320*b*, the gas-liquid separation chamber 312 and the connection hole 319*a* passes, on the way, through the sheet member 316 (FIG. 8) bonded to the dike 313. The gas-liquid separation chamber 312 communicates with the connecting flow path 314 via the connection holes 319*a* and 319*b* and the internal flow path formed inside the tank main body. The connecting flow path 314 connects with the air chamber 330 via the open-air hole 318. As clearly understood from the above description, the sheet member 316 (FIG. 8) separates the open-air hole 318 from the outside. This structure prevents ink contained in the tank main body 32 from leaking outside.

Figure 11A:
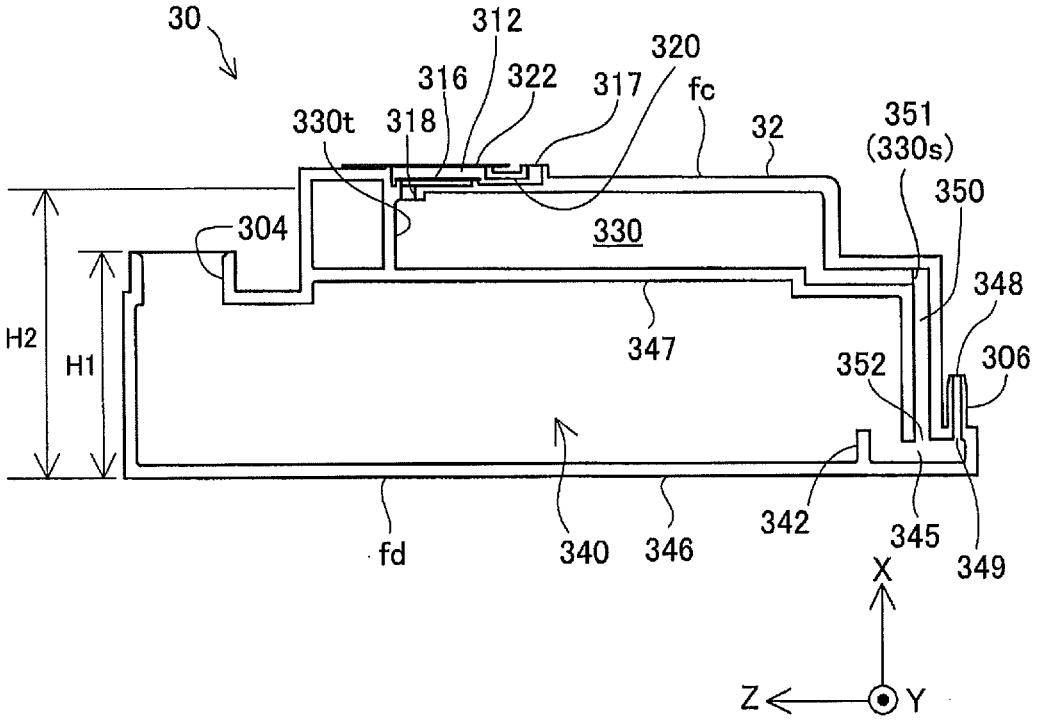
FIGS. 11A and 11B are explanatory diagrams showing the details of the ink tank 30.
Figure 11B:
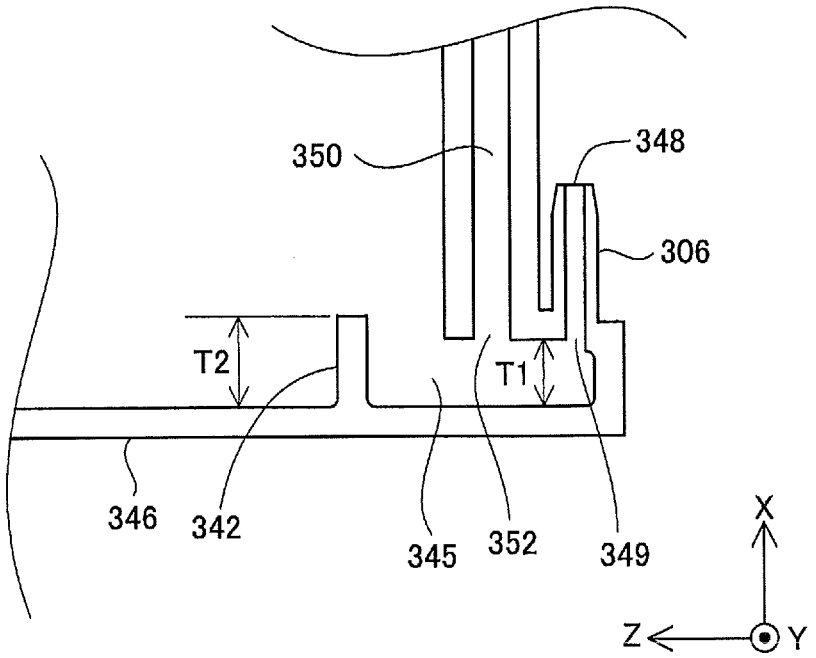

FIGS. 11A and 11B are explanatory diagrams showing the details of the ink tank 30. FIG. 11A is a view of the inside of the tank main body 32 of FIG. 8 seen from the positive direction of the Y axis. FIG. 11B is a close-up view of the periphery of the liquid discharge port 306 of FIG. 11A. For the convenience of explanation, the liquid discharge port 306 is illustrated to connect with the liquid chamber 340, although the liquid discharge port 306 is located at the depth from the sheet surface in the actual state. Additionally, for the convenience of explanation, the structures of the ink tank 30 not directly involved in the following explanation, for example, the open-air hole 318 and the relevant structure (for example, the sheet member 316 and the gas-liquid separation chamber 312) and the liquid inlet 304, are only conceptually illustrated. The relationship of the height of the open-air hole 318 to the height of the liquid inlet 304 in FIG. 11A is, however, illustrated corresponding to the actual height relationship.

Referring to FIG. 11A, the ink tank 30 is mounted such that the left side wall fd is located downward in the vertical direction (negative direction of the X axis) in the filling attitude of the ink tank 30. In other words, the ink tank 30 is mounted such that the face fd opposed to the face having the liquid inlet 304 and the open-air hole 318 is located to form the bottom face.

The liquid chamber 340 communicates with the liquid discharge port 306. The liquid contained in the liquid chamber 340 can be flowed from the liquid outlet 349 of the liquid chamber 340 to the liquid discharge port 306. Since the liquid outlet 349 can be regarded as one end of the liquid discharge port 306, the liquid outlet 349 is also called one end 349 of the liquid discharge port 306. The liquid chamber 340 has the partition wall member 342 extended upward by a predetermined length from a bottom face 346 in the filling attitude. The partition wall member 342 is formed over the entire length in the Y-axis direction (width direction) in the liquid chamber 340. In other words, the partition wall member 342 parts the bottom face 346 into two regions.

Referring to FIG. 11B, in the filling attitude, height T2 of the liquid retainer 345 (i.e., height T2 of the partition wall member 342) is higher than height T1 of one end 349. Even when the attitude of the ink tank 30 is changed from the use attitude to the filling attitude with a decrease in residual amount of ink in the liquid chamber 340, this arrangement enables the liquid retainer 345 to be filled with ink of not lower than the height T1. In the filling attitude, the liquid retainer 345 retains a certain amount of ink, so as to maintain the state that the ink in the liquid discharge port 306 is continuous with the ink in the liquid retainer 345 without the air. In other words, one end 349 is kept in contact with ink, while being kept from coming in contact with the air.

The partition wall member 342 is designed such that the upper end of the partition wall member 342 is kept from coming in contact with an upper face 347 of the liquid chamber 340 and does not interfere with the flow of ink between the liquid retainer 345 and the remaining part in the liquid chamber 340. The position of the partition wall member 342 is not specifically limited on the bottom face 346 but is preferably close to one end 349. The partition wall member 342 is thus preferably provided to minimize the bottom area of the liquid retainer 345 and thereby enable the liquid retainer 345 to be filled with ink of not lower than the height T1 even in the condition of the less residual amount of ink. The expression of "close to" herein means that the partition wall member 342 is disposed to have a minimum clearance (flow path) sufficient to allow for the flow of ink in the liquid chamber 340 (i.e., avoid interfering with the flow of ink) when the ink in the liquid chamber 340 is supplied to the printer 12 via the liquid discharge port 306.

The ink tank 30 is further described with referring back to FIG. 11A. The connection path 350 is formed as the elongated flow path. When the air contained in the liquid chamber 340 is thermally expanded and causes the ink in the liquid chamber 340 to flow into the connection path 350, the air chamber 330 accumulates a certain amount of ink and thereby prevents ink from leaking outside via the open-air hole 318. As the ink contained in the liquid chamber 340 is supplied to the sub-tank 20, the air in the air chamber 330 is introduced via the connection path 350 into the liquid chamber 340. This will be described more in detail later.

The connection path 350 has the smaller flow path cross-sectional area and the higher flow path resistance than the air chamber 330 and the liquid chamber 340. This causes the meniscus (liquid bridging) in the connection path 350.

The air chamber 330 communicates with the outside air via the open-air hole 318. The open-air hole 318 is formed such as to be located closer to an upper face 330*t* of the air chamber 330 than a bottom face 330*s* in the use attitude.

The liquid inlet 304 is formed in the tank main body 32 to be located at the lower position than the open-air hole 318 in the filling attitude. This means that height H1 of the liquid inlet 304 is less than height H2 of the open-air hole 318 in the filling attitude. The comparison between the height of the liquid inlet 304 and the height of the open-air hole 318 is on the basis of the respective upper end faces in the filling attitude.

Figure 12:
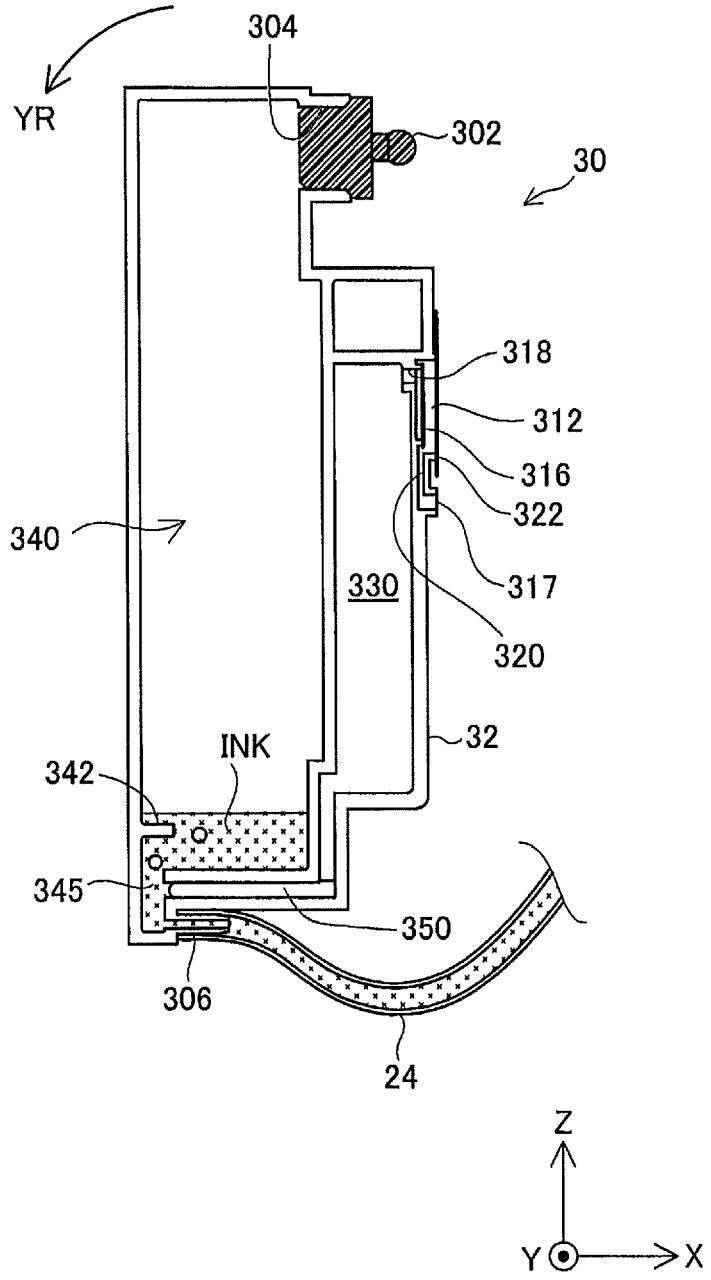
FIG. 12 is an explanatory diagram showing the ink tank 30.

FIG. 12 is an explanatory diagram showing the ink tank 30. FIG. 12 shows the ink tank 30 of FIG. 11A in the use attitude. More specifically, FIG. 12 shows the supply of ink from the ink tank 30 to the sub-tank 20 via the hose 24 in the use attitude (use state).

As shown in FIG. 12, when the residual amount of ink in the liquid chamber 340 is lowered to or below a preset level, the user is required to refill the ink, in order to prevent failure of the printer 12 (e.g., missing dots). For example, a limit line may be provided on the tank main body 32 as the indication of ink filling timing, and the user is required to refill ink at the ink level of or below the limit line. It is here assumed that the ink level is lowered to or below the limit line in the state of FIG. 12. When ink is filled into the liquid chamber 340, the ink tank 30 is rotated to face the liquid inlet 304 upward in the vertical direction as shown by arrow YR.

FIGS. 13A to 13C show ink filling to the ink tank 30. FIG. 13A shows the ink tank 30 having the same residual amount of ink as that of FIG. 12 with changing the attitude from the use attitude to the filling attitude. FIG. 13B shows the state of filling a normal amount of ink into the liquid chamber 340. FIG. 13C shows the state of filling an excess amount of ink into the liquid chamber 340. "Filling a normal amount of ink into the liquid chamber 340" means that the amount of ink less than a preset amount is stored in the liquid container 340; for example, ink is filled into the liquid chamber 340 such that the ink level is lower than the liquid inlet 304. "Filling an excess amount of ink into the liquid chamber 340" means that ink is filled until the amount of ink stored in the liquid container 340 reaches or exceeds the preset amount; for example, ink is filled into the liquid chamber 340 such that the ink level reaches the liquid inlet 304.

At the time of ink filling, the plug member 302 (FIG. 12) attached to the liquid inlet 304 is detached to enable ink to be filled through the liquid inlet 304 as shown in FIG. 13A. Ink is filled in the state that the ink tank 30 is connected with the sub-tank 20 by means of the hose 24. The meniscus (liquid bridging) is formed in the nozzle of the recording head 17 (FIG. 7), so that the ink is not ejected from the nozzle unless external force is applied to the ink (i.e., the pressure is applied to the ink by a piezoelectric element). The nozzle of the recording head 17 retains ink with a fixed force, so that the ink in the liquid discharge port 306 connecting with the nozzle is retained inside the liquid discharge port 306 without flowing back toward the liquid chamber 340.

When the attitude of the ink tank having a small residual amount of ink is changed from the use attitude to the filling attitude as shown in FIG. 13A, the liquid retainer 345 prevents ink from flowing out to the remaining part of the liquid chamber 340. In other words, the partition wall member 342 blocks the flow of ink in the direction away from one end 349 (i.e., in the positive direction of the Z axis). In the filling attitude, the liquid retainer 345 thus maintains the higher ink level than the remaining part. More specifically, the partition wall member 342 enables the liquid level of the liquid retainer 345 to be maintained at the height equal to or higher than one end 349. Even in the state of small residual amount of ink, the ink in the liquid discharge port 306 is thus continuous with the ink in the liquid retainer 345 without the air. This lowers the probability that the air (air bubbles) flows through one end 349 into the liquid discharge port 306 and further enters the sub-tank 20 via the hose 24 during ink filling. Preventing the air from entering the recording head 17 (FIG. 7) during ink filling prevents missing dots, thus keeping the good printing quality.

Referring to FIG. 13B, when a normal amount of ink is filled into the liquid chamber 340, ink level Lf1 in the liquid chamber 340 is located below the liquid inlet 304 in the filling attitude. Since the height H1 of the liquid inlet 304 is lower than the height H2 of the open-air hole 318 in the filling attitude, this structure prevents ink from overflowing from the open-air hole 318 when the normal amount of ink is filled into the liquid chamber 340.

Referring to FIG. 13C, even when an excess amount of ink is filled and the ink level reaches the liquid inlet 304, this structure prevents ink from overflowing from the open-air hole 318. This structure also lowers the probability that the whole surface of the sheet member 316 is wetted with ink during ink filling, so that the function of the sheet member 316 can be maintained over a long time period.

As described above, in the ink tank 30 of the first embodiment, the liquid inlet 304 is located below the open-air hole 318 in the filling attitude. This structure lowers the probability that ink overflows from the open-air hole 318 during ink filling. When the attitude of the ink tank 30 is changed from the use attitude to the filling attitude with a decrease in residual amount of ink, the presence of the liquid retainer 345 enables the ink in the liquid discharge port 306 to be continuous with the ink in the liquid retainer 345 (FIG. 13A). This structure lowers the probability that the air enters the recording head 17 via the liquid discharge port 306 and the hose 24 during ink filling into the liquid chamber 340.

B-2. Second Embodiment

Figure 14A:
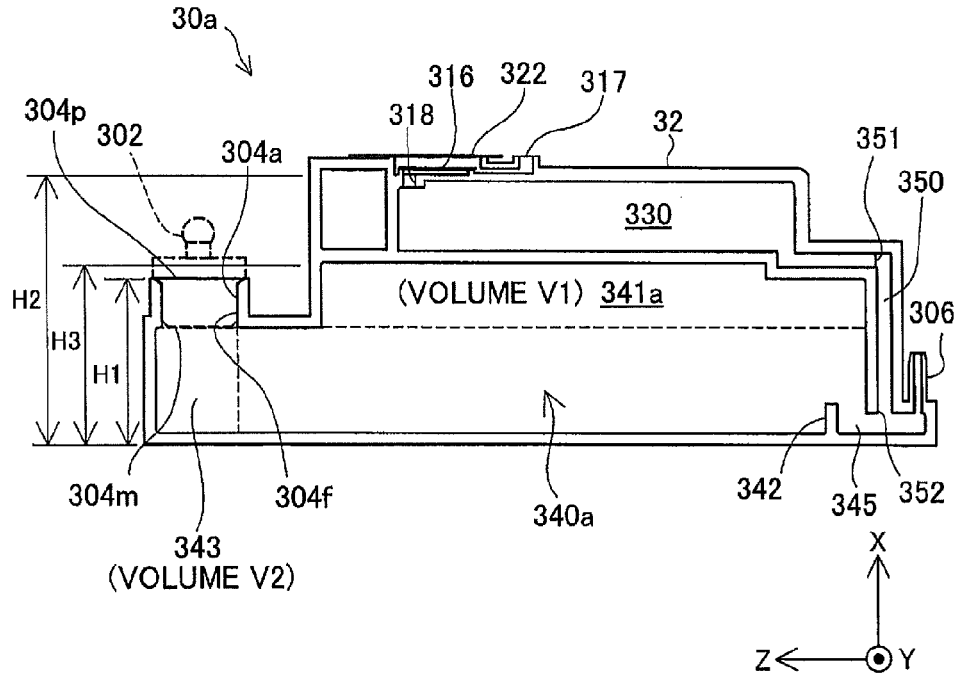
FIGS. 14A and 14B are explanatory diagrams showing an ink tank 30*a* according to a second embodiment.
Figure 14B:
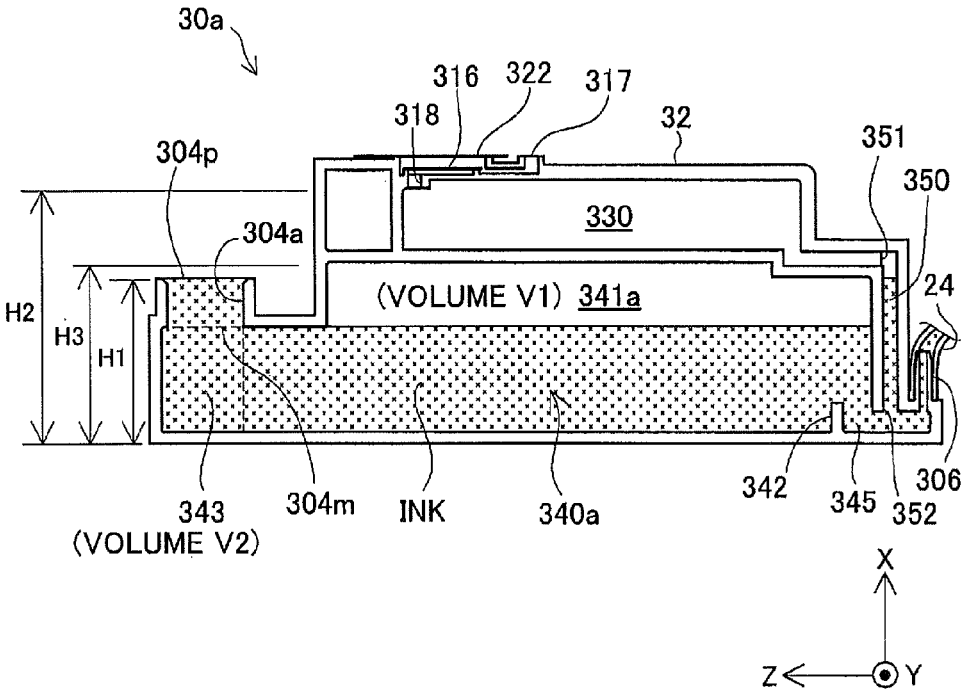

FIGS. 14A and 14B are explanatory diagrams showing an ink tank 30*a* according to a second embodiment. FIGS. 14A and 14B are the view corresponding to FIG. 11A of the first embodiment. FIG. 14A illustrates the structure of the ink tank 30*a* of the second embodiment. FIG. 14B illustrates the state of the ink tank 30*a* when an excess amount of ink is filled. The differences from the ink tank 30 of the first embodiment are the structure of a liquid chamber 340*a* and the height of a liquid inlet 304*a* in the filling attitude. Otherwise the structures of the second embodiment are similar to those of the first embodiment and are thus expressed by the like numerals and symbols and are not specifically described here. Like the ink tank 30 of the first embodiment, the ink tank 30*a* of the second embodiment is used for the liquid ejection system 1 (FIGS. 3A and 3B). For the better understanding, a plug member 302 is shown by the broken line in FIG. 14A.

As shown in FIG. 14A, the liquid inlet 304*a* is provided in the tank main body 32 at a height lower than an open-air hole 318 and an opening 351 at one end 351 of a connection path 350 in the filling attitude. In other words, height H1 of the liquid inlet 304*a* is less than height H2 of the open-air hole 318 and height H3 of one end 351 in the filling attitude.

The liquid chamber 340*a* includes a specific space 341*a* of volume V1. The specific space 341*a* of the volume V1 is also called air reserving space 341*a*. The air reserving space 341*a* is a portion provided at a higher position than an opening 304*m* (also called "lower end opening 304*m*" or "lower end 304*m*"), which is one end of the liquid inlet 304*a* and is formed in the wall surface of the liquid chamber 340*a*, in the liquid chamber 340*a* in the filling attitude. The air reserving space 341*a* is a recess defined by the wall surface of the liquid chamber 340*a* and is open downward in the vertical direction in the filling attitude. In other words, the air reserving space 341*a* has the circumference (directions) other than downward in the vertical direction surrounded by the wall surface of the liquid chamber 340*a* in the filling attitude. The air reserving space 341*a* enables a certain amount of the air (volume V1) to be accumulated in the filling attitude even when an excess amount of ink is filled into the liquid chamber 340*a* to the level of an upper end opening 304*p* (also called "upper end 304*p*") of the liquid inlet 304*a*. This means that the air reserving space 341*a* is capable of accumulating at least a certain amount of the air (volume V1), irrespective of the filling amount of ink in the filling attitude. A specific portion of the liquid chamber 340*a* occupying a location of not lower than the height of the liquid inlet 304*a* in the use attitude is defined as inlet adjacent portion 343. More specifically, the inlet adjacent portion 343 is located at the height of or above a bottom end 304*f* of the liquid inlet 304*a* in the use attitude. When the inlet adjacent portion 343 has volume V2, the ink tank 30*a* meets the relational expression of V1≥V2.

As shown in FIG. 14B, even when an excess amount of ink is filled into the liquid chamber 340*a* to, for example, the level of the liquid inlet 304*a*, ink does not flow into the air chamber 330 since H1<H3. Additionally, even when an excess amount of ink is filled into the liquid chamber 340*a*, the presence of the air reserving space 341*a* ensures accumulation of the air of the volume V1 in the liquid chamber 340*a*.

Figure 15:
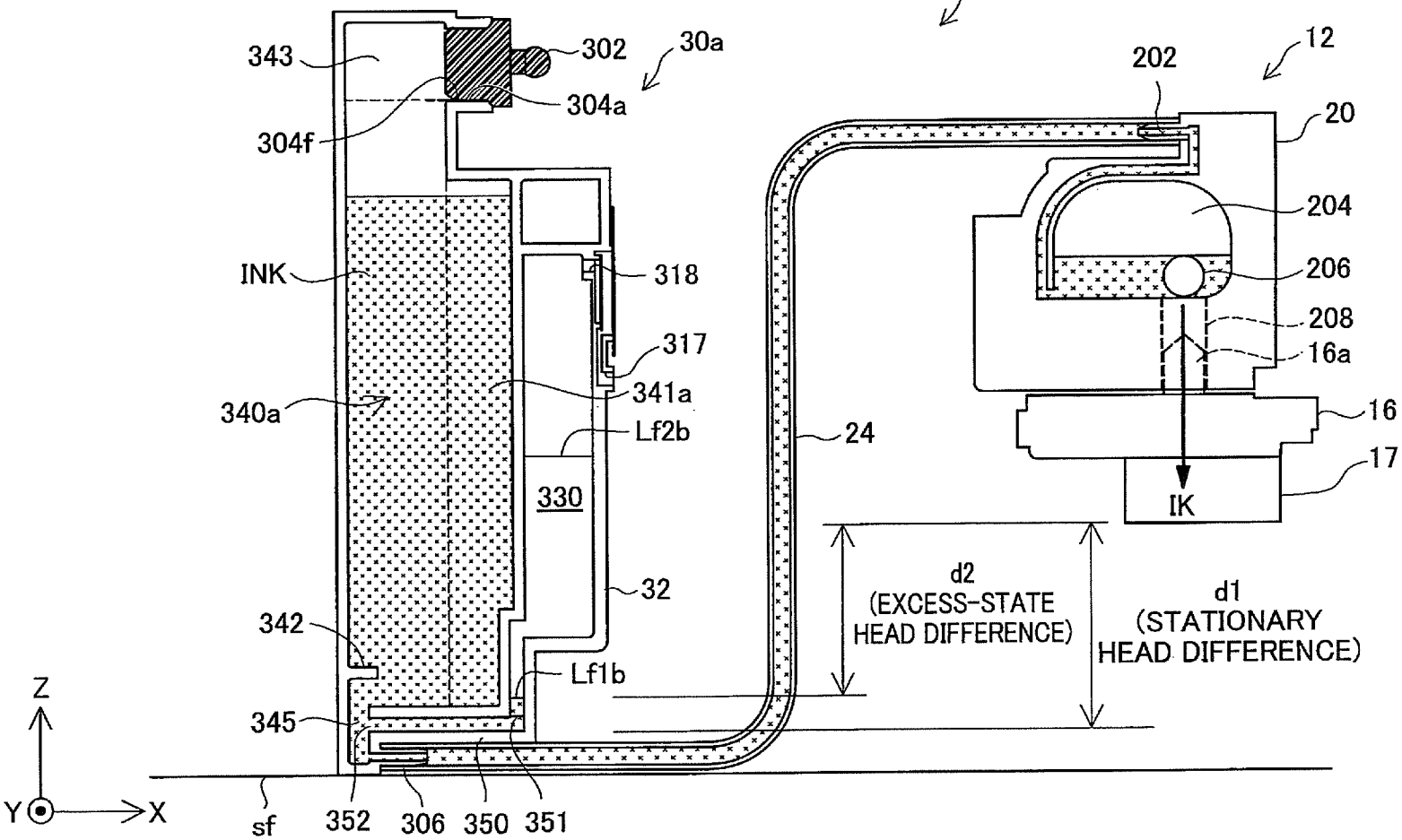
FIG. 15 is an explanatory diagram showing the advantageous effects of the second embodiment.

FIG. 15 is an explanatory diagram showing the advantageous effects of the second embodiment. FIG. 15 illustrates the internal state of the liquid ejection system 1 in the use attitude. More specifically, FIG. 15 shows the immediate state of ink when the attitude of the ink tank 30*a* is changed to the use attitude after filling an excess amount of ink as shown in FIG. 14B.

Since ink level does not reach the air chamber 330 even when an excess amount of ink is filled into the liquid chamber 340*a* as shown in FIG. 14B, ink hardly flows into the air chamber 330 in the use attitude as shown in FIG. 15. The air chamber 330 accordingly has liquid level Lf1*b* immediately after ink filling. In this state, there is a head difference d2. This head difference d2 is called "excess-state head difference d2". As the ink in the ink tank 30*a* is supplied to the sub-tank 20, the liquid level Lf1*b* is gradually lowered and eventually reaches the position of the meniscus formed at the other end 352 (FIG. 7). If ink flows into the air chamber 330 during ink filling, the air chamber 330 has liquid level higher than the liquid level Lf1*b* (for example, liquid level Lf2*b*) in the use attitude immediately after the ink filling. This causes a head difference significantly deviated from the stationary head difference d1. In the structure of this embodiment, however, since the height H1 is less than the height H3 (FIG. 14A), ink does not flow into the air chamber 330 during ink filling. This reduces the deviation of the excess-state head difference d2 from the stationary head difference d1. In other words, the head difference is maintained in a certain range. This enables ink to be stably supplied from the ink tank 30*a* to the sub-tank 20, as the ink stored in the ink reserving chamber 204 of the sub-tank 20 is consumed.

The volume V1 of the air reserving space 341*a* is not less than the volume V2 of the inlet adjacent portion 343, so that no ink is present in the inlet adjacent portion 343 in the use attitude even when an excess amount of ink is filled into the ink tank 30*a*. This lowers the probability that the plug member 302 comes into contact with ink and thereby the probability that the ink is contaminated with the impurity of the plug member 302. As in the structure of the first embodiment, in the structure of the second embodiment, since the liquid inlet 304*a* is lower than the open-air hole 318 in the filling attitude (FIGS. 14A and 14B), this structure lowers the probability that ink overflows from the open-air hole 318 during ink filling.

B-3. Third Embodiment

Figure 16:
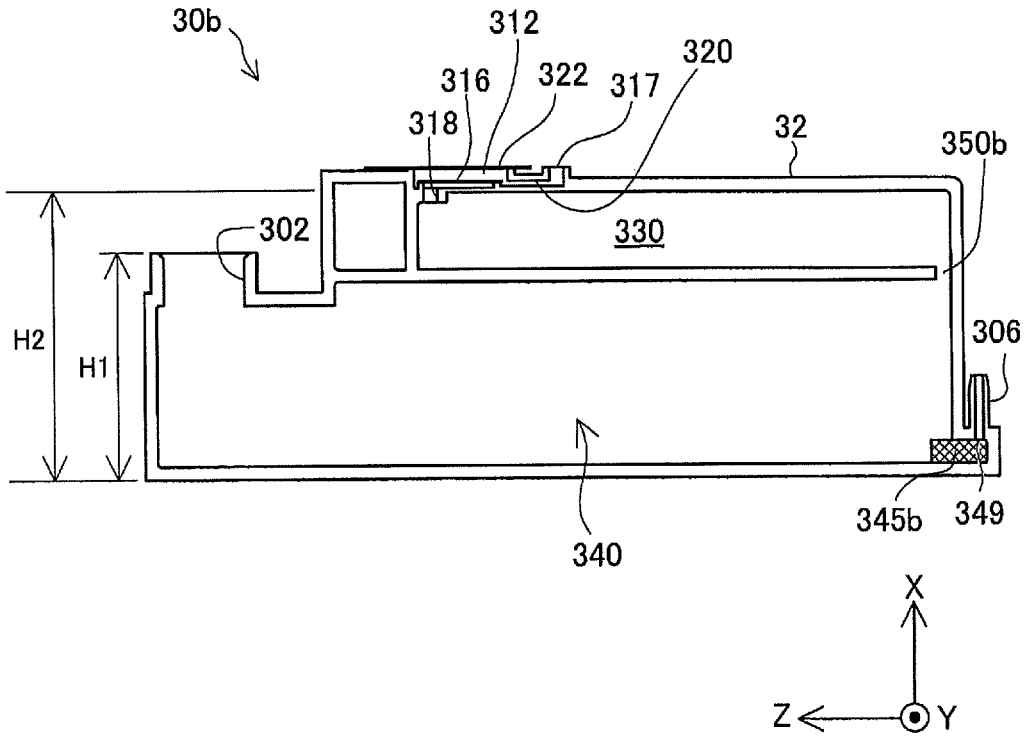
FIG. 16 is an explanatory diagram showing an ink tank 30*b* according to a third embodiment.

FIG. 16 is an explanatory diagram showing an ink tank 30*b* according to a third embodiment. FIG. 16 is the view corresponding to FIGS. 11A and 14A of the above embodiments. The differences from the first embodiment are the structure of a connection path 350*b* and the structure of a liquid retainer 345*b*. Otherwise the structures of the third embodiment are similar to those of the first embodiment and are thus expressed by the like numerals and symbols and are not specifically described here.

The ink tank 30*b* of the third embodiment has the connection path 350*b* provided in the form of an aperture instead of the elongated flow path. The connection path 350*b* has an opening area sufficient to form the meniscus. Additionally, a porous member 345*b* is provided to close one end 349 in the liquid chamber 340. This porous member 345 serves as the liquid retainer to retain a certain amount of ink. The porous member 345*b* forms an inner through-path to enable ink in the liquid chamber 340 to be flowed toward the liquid discharge port 306 when the ink stored in the liquid chamber 340 is supplied to the sub-tank 20. The porous member 345*b* may be made of, for example, a sponge material.

The connection path 350*b* in the form of an aperture further simplifies the structure of the ink tank 30*b*. The porous member 345*b* maintains the continuous state of the ink in the liquid discharge port 306 with the ink in the porous member 345*b* without the air. This lowers the probability that the air (air bubbles) flows from one end 349 into the sub-tank 20 through the liquid discharge port 306 and the hose 24 during ink filling. Like the above embodiments, the structure of the ink tank 30*a* of the third embodiment lowers the probability that ink overflows from the open-air hole 318 during ink filling.

In the third embodiment, the connection path 350*b* may be replaced with the connection path 350 in the form of an elongated flow path described in the above embodiments. Additionally, in the third embodiment, the porous member 345*b* may be replaced with the liquid retainer 345 defined by the partition wall member 342. Like the above embodiments, this modified structure also lowers the probability that ink overflows from the open-air hole 318 during ink filling and the probability that the air flow into the sub-tank during ink filling. The partition wall member 342 may be provided in addition to the porous member 345*b*. This modified structure more favorably maintains the continuous state of the ink in the liquid discharge port 306 with the ink in the liquid retainer 345 without the air.

B-4. Fourth Embodiment

B-4-1. Description of Liquid Ejection System and Ink Tank

Figure 17A:
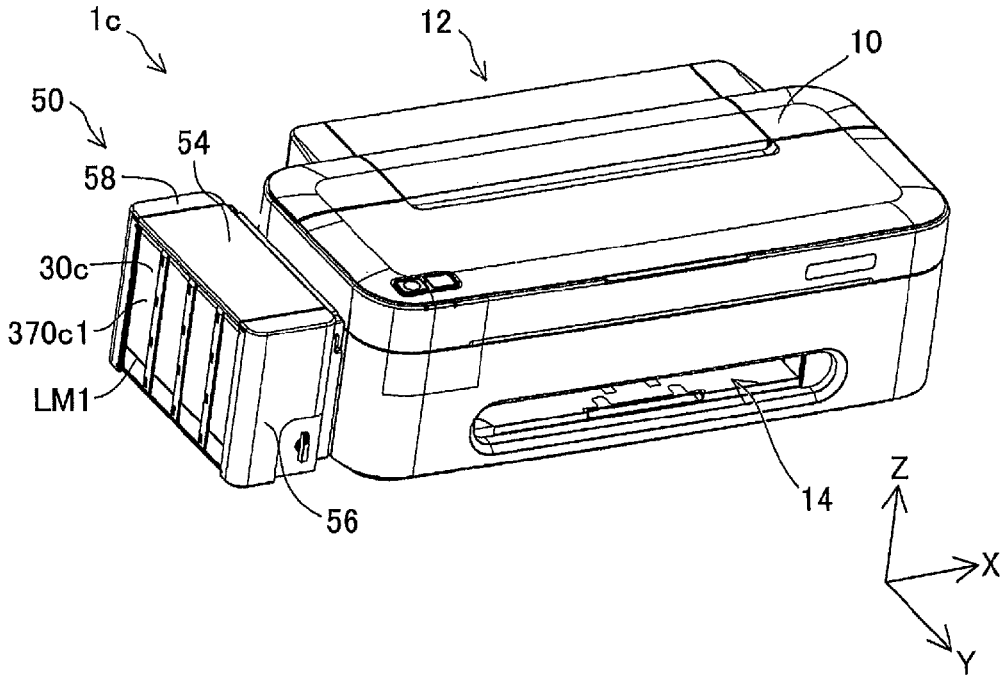
FIGS. 17A and 17B are explanatory diagrams showing a liquid ejection system 1*c* according to a fourth embodiment.
Figure 17B:
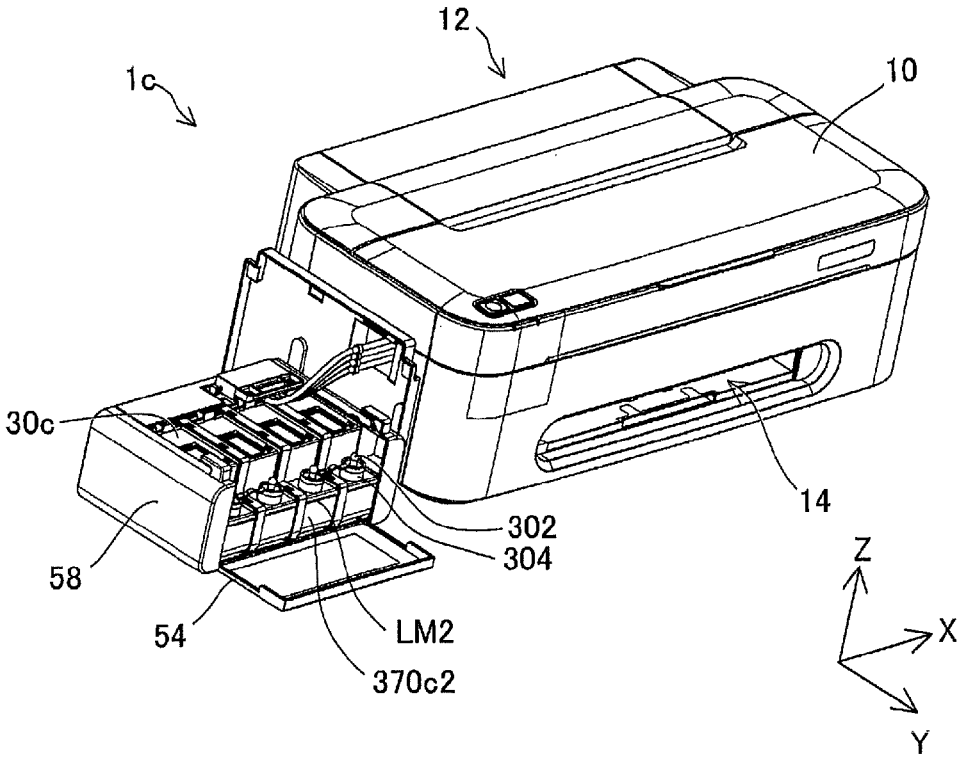

FIGS. 17A and 17B are explanatory diagrams showing a liquid ejection system 1*c* according to a fourth embodiment. FIG. 17A illustrates the liquid ejection system 1*c* including ink tanks 30*c* in the use attitude. FIG. 17B illustrates the liquid ejection system 1*c* including the ink tanks 30*c* in the filling attitude. The liquid ejection system 1*c* is located and used on a mounting surface as a horizontal surface defined by X axis and Y axis. The difference from the liquid ejection system 1 of the first embodiment is the external structure of the ink tank 30*c*. More specifically, unlike the ink tank 30 of the first embodiment, the ink tank 30*c* has indications LM1 and LM2 on the wall surface for visually checking the ink level. Otherwise the structures of the third embodiment (the printer 12 and the internal structure of the ink tank 30*c*) are similar to those of the first embodiment. The like structures to those of the first embodiment are expressed by the like numerals and symbols and are not specifically described here.

Referring to FIG. 17A, the ink tank 30*c* is set such that a partial wall member (first wall member) 370*c*1 is visible from the outside in the use attitude. The first wall member 370*c*1 is a vertically-angled wall member relative to the mounting surface in the use attitude. In other words, the first wall member 370*c*1 is extended toward the upper side from the lower side in the use attitude of the ink tank 30*c*. In this embodiment, the first wall member 370*c*1 is the wall member provided at substantially right angle to the mounting surface. The first wall member 370*c*1 forms the bottom face of the ink tank 30*c* in the filling attitude of the ink tank 30*c*. The ink tanks 30, 30*a* and 30*b* of the first through the third embodiments described above similarly have the first wall member 370*c*1.

The first wall member 370*c*1 has a lower limit line LM1 provided as the lower limit element. The lower limit line LM1 forms a horizontal straight line in the use attitude. The lower limit line LM1 is provided to show that the ink in the ink tank 30*c* is consumed and the ink level in the ink tank 30*c* reaches a first threshold value in the use attitude of the ink tank 30*c*. The user refills ink into the ink tank 30*c* when the ink level approaches the first threshold value.

Referring to FIG. 17B, for filling (refilling) ink into the ink tank 30*c*, the user changes the attitude of the ink tank 30*c* from the use attitude to the filling attitude in which the liquid inlet 304 is open upward in the vertical direction (i.e., positive direction of the Z axis). The user then opens the upper casing 54, detaches the plug member 302 from the liquid inlet 304 and fills ink through the liquid inlet 304 into the ink tank 30*c*.

Opening the upper casing 54 causes a second wall member 370*c*2 different from the first wall member 370*c*1 to be visible from the outside. The second wall member 370*c*2 is a vertically-angled wall member relative to the mounting surface. In other words, the second wall member 370*c*2 is extended toward the upper side from the lower side in the filling attitude. In this embodiment, the second wall member 370*c*2 is the wall member provided at substantially right angle to the mounting surface in the filling attitude. The ink tanks 30, 30*a* and 30*b* of the first through the third embodiments described above similarly have the second wall member 370*c*2.

The second wall member 370*c*2 has an upper limit line LM2 as the upper limit element. The upper limit line LM2 forms a horizontal straight line in the filling attitude. The upper limit line LM2 is provided to shows that ink is filled through the liquid inlet 304 into the liquid chamber 340 and the ink level in the liquid chamber 340 reaches a second threshold value in the filling attitude of the ink tank.

The user fills (refills) ink into the ink tank 30*c* until the ink level approaches the upper limit line LM2. After the ink refilling, the attitude of the ink tank 30*c* is changed to the use attitude shown in FIG. 17A. This structure facilitates the user to visually check the ink level inside the ink tank 30*c* in the respective attitudes.

Figure 18:
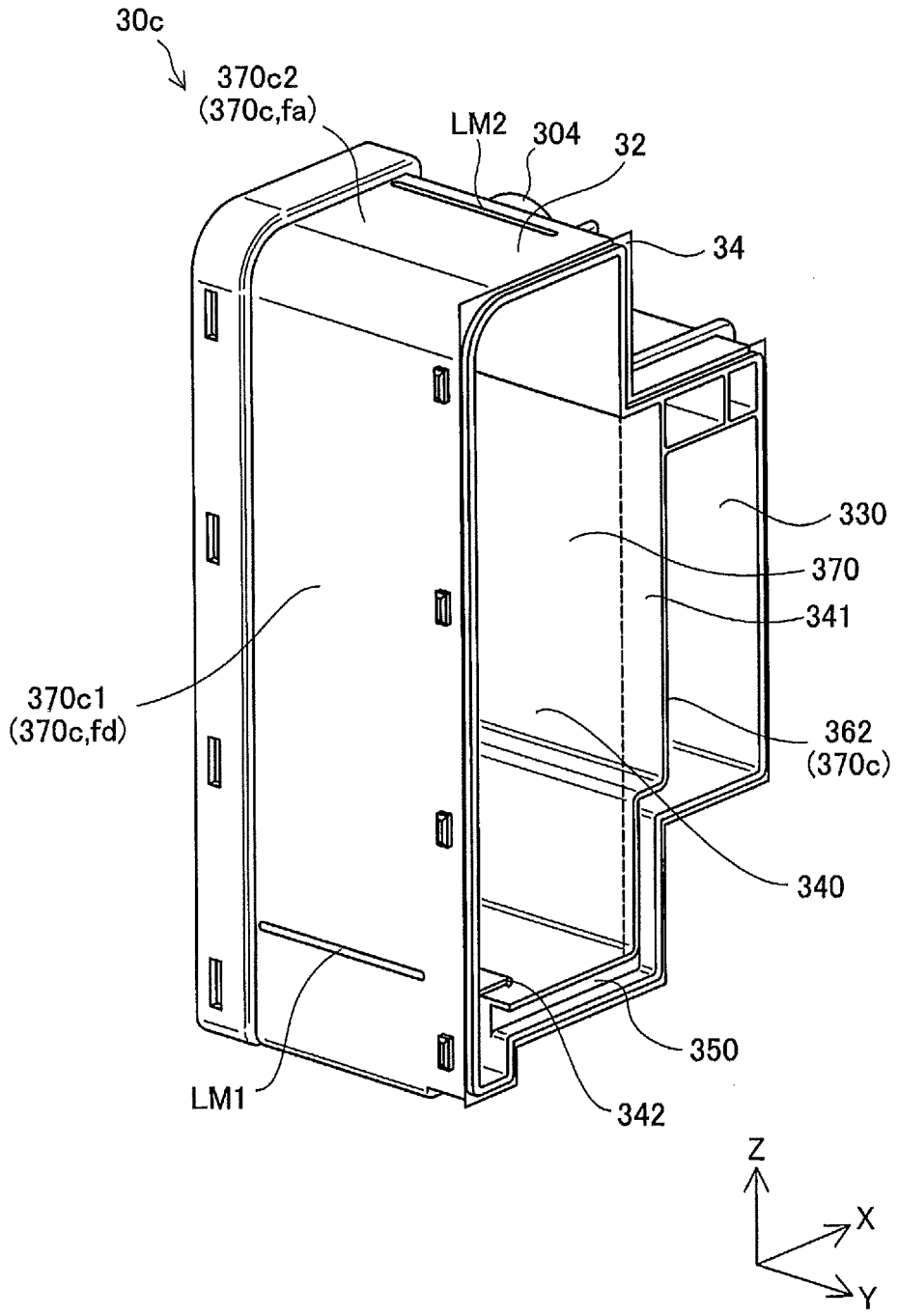
FIG. 18 is a perspective view showing the appearance of an ink tank 30*c* of the fourth embodiment.

FIG. 18 is a perspective view showing the appearance of the ink tank 30*c*. As shown in FIG. 18, the plurality of connecting wall members 370*c* include the first wall member 370*c*1, the second wall member 370*c*2 and the third wall member 370*c*3 (FIG. 8). The first wall members 370*c*1 are visible from the outside when the ink tanks 30*c* are assembled as the tank unit 50 (FIG. 17A), while the second wall members 370*c*2 are visible from the outside when the upper casing 54 is opened (FIG. 17B). Among the plurality of wall members defining the liquid chamber 340, the open wall member 370 and the opposed wall member 370*b* (FIG. 10) having the planes orthogonal to the alignment direction of the plurality of ink tanks 30*c* (i.e., stacking direction or the Y-axis direction) are invisible from the outside when the ink tanks 30*c* are assembled as the tank unit 50.

As shown in FIG. 18, the lower limit line LM1 and the upper limit line LM2 are provided as projections protruded from the outer surfaces of the wall members 370*c*1 and 370*c*2 and are integrally formed with the tank main body 32. In the use attitude of the ink tank 30*c*, the second flow path 350 is located below the lower limit line LM1.

B-4-2. Ink Filling Method

Figure 19:
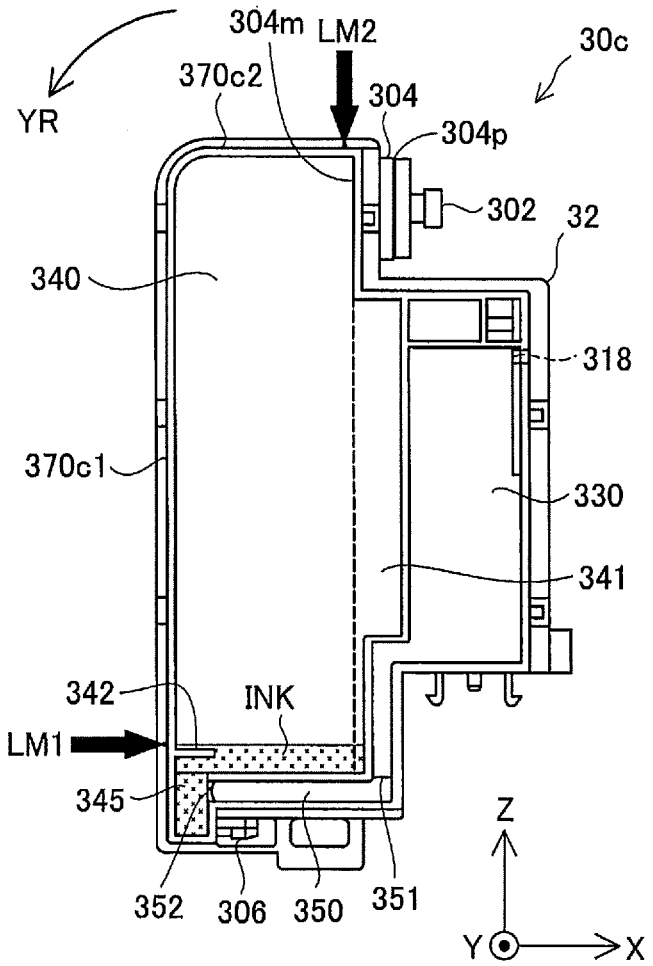
FIG. 19 shows the state of a small residual amount of ink in a liquid chamber 340.

FIG. 19 shows the state of the small residual amount of ink in the liquid chamber 340. Although the liquid discharge port 306 is actually connected with the liquid receiving port 202 of the sub-tank 20 by means of the hose 24, the hose is omitted from the illustration.

As shown in FIG. 19, as the ink in the liquid chamber 340 is supplied to the printer 12 and is consumed, the ink level is gradually lowered and reaches the lower limit line LM1. The lower limit line LM1 is the indication for showing that the residual amount of ink in the liquid chamber 340 is decreasing and for urging the user to fill ink (refill ink) into the liquid chamber 340 in the use attitude of the ink tank 30*c*. In other words, the lower limit line LM1 is the indication for showing that the amount of ink in the liquid chamber 340 reaches the first threshold value. When the ink level approaches the lower limit lime LM1, the user is required to fill (refill) ink into the liquid chamber 340. The liquid container 30*c* uses this lower limit line LM1 to urge the user to refill ink into the liquid chamber 340 and thereby prevents printing with the printer 12 out of ink in the liquid chamber 340. This lower the probability that the air (air bubbles) is introduced from the liquid chamber 340 into the printer 12 and prevents the occurrence of failure of the printer 12 (for example, missing dots).

When ink is filled into the liquid chamber 340, the ink tank 30*c* is rotated as shown by arrow YR to change the opening direction of the liquid inlet 304 from the horizontal direction to upward in the vertical direction. This changes the attitude of the ink tank 30*c* from the use attitude to the filling attitude. The ink tank 30*c* can thus be set in two different attitudes, i.e., the use attitude and the filling attitude, having the different opening directions of the upper end 304*p* of the liquid inlet 304. The user changes the attitude of the ink tank 30*c* to the filling attitude and opens the upper casing 54 (FIG. 17A), so that the second wall member 370*c*2 having the upper limit line LM2 is visible from the outside.

Figure 20A:
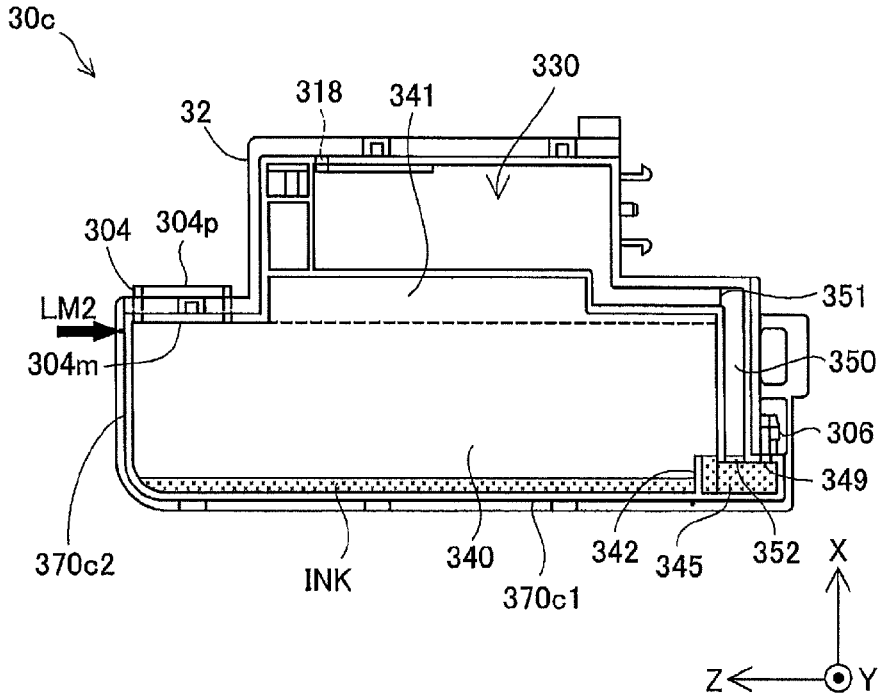
FIGS. 20A and 20B are explanatory diagrams showing ink filling into the ink tank 30*c;*
Figure 20B:
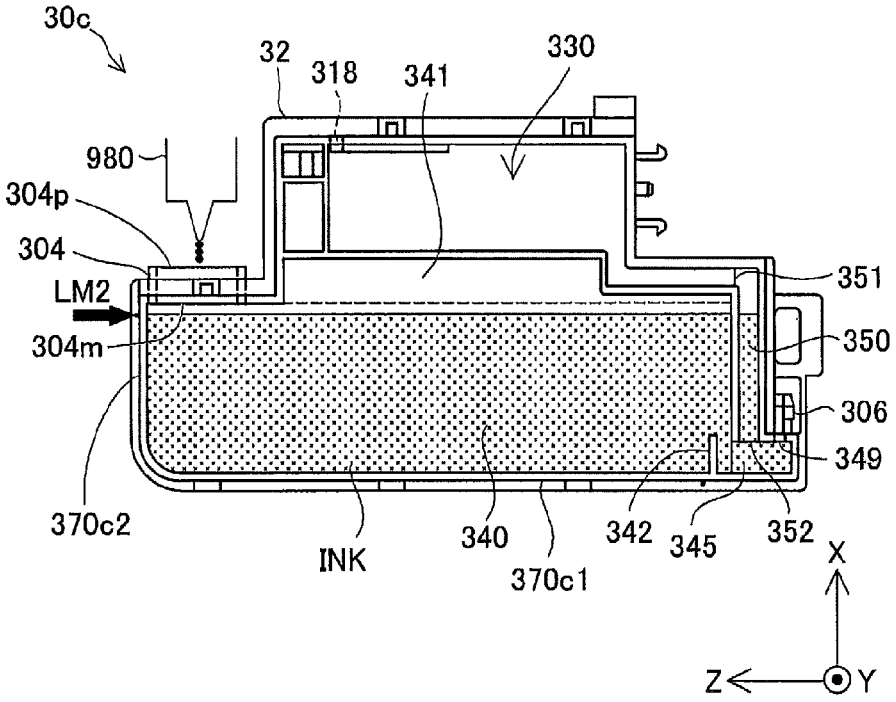

FIGS. 20A and 20B are explanatory diagram showing ink filling into the ink tank 30*c*. FIG. 20A shows the state of ink in the ink tank 30*c* when the attitude of the ink tank 30*c* is changed from the use attitude to the filling attitude after the ink level reaches the lower limit line LM1. FIG. 20B shows the state of ink when ink is filled through the liquid inlet 304 into the liquid chamber 340 and the ink level reaches the upper limit line LM2. FIGS. 20A and 20B are the views of the ink tank 30*c* seen from the positive direction of the Y axis. Although the liquid discharge port 306 is actually connected with the liquid receiving port 202 of the sub-tank 20 by means of the hose 24, the hose 24 is omitted from the illustration of FIGS. 20A and 20B. FIG. 20A shows the state of detachment of the plug member 302 from the ink tank 30*c* in the filling attitude.

While the second flow path 350 including the air-side opening 351 is located below the lower end 304*m* or the other end of the liquid inlet 304 in the use attitude, the air-side opening 351 is located above the lower end 304*m* in the filling attitude of the ink tank 30*c* as shown in FIG. 20A. In the filling attitude, the upper end 304*p* of the liquid inlet is open upward in the vertical direction. Additionally, in the filling attitude, the air chamber 330 and the liquid chamber 340 are aligned in the vertical direction, and the air chamber 330 is disposed above the liquid chamber 340.

Like the first embodiment, when the attitude of the ink tank having a small residual amount of ink is changed from the use attitude to the filling attitude, the liquid retainer 345 prevents ink from flowing out to the remaining part of the liquid chamber 340. In other words, the partition wall member 342 blocks the flow of ink in the direction away from the liquid outlet 349 (i.e., in the positive direction of the Z axis). In the filling attitude, the liquid retainer 345 thus maintains the higher ink level than the remaining part. More specifically, the partition wall member 342 extended to the higher position than the liquid outlet 349 in the filling attitude enables the ink level (liquid level) of the liquid retainer 345 to be maintained at the height equal to or higher than the liquid outlet 349. Like the above embodiment, this structure prevents the air from entering the recording head 17 (FIG. 7) during ink filling and thereby prevents missing dots, thus keeping the good printing quality.

Referring to FIG. 20B, a refill container 980 for storing ink is used to refill ink into the liquid chamber 340. More specifically, ink is dropped from the refill container 980 to the liquid chamber 340 and is refilled into the liquid chamber 340. The upper limit line LM2 is provided to inform the user of that a sufficient amount of ink is filled through the liquid inlet 304 into the liquid chamber 340 (i.e., the amount of ink such that the ink level reaches the liquid inlet 304 but ink does not overflow from the liquid inlet 304: second threshold value). As shown in FIG. 20B, the user fills ink into the liquid chamber 340 to such an extent that the ink level in the liquid chamber 340 reaches the upper limit line LM2. In the filling attitude, when the liquid chamber 340 is filled with ink to such an extent that ink does not overflow from the liquid inlet 304, the air-side opening 351 is located above the ink level. This structure prevents ink from being introduced into the air chamber 330 via the airside opening 351 during ink filling.

Figure 21:
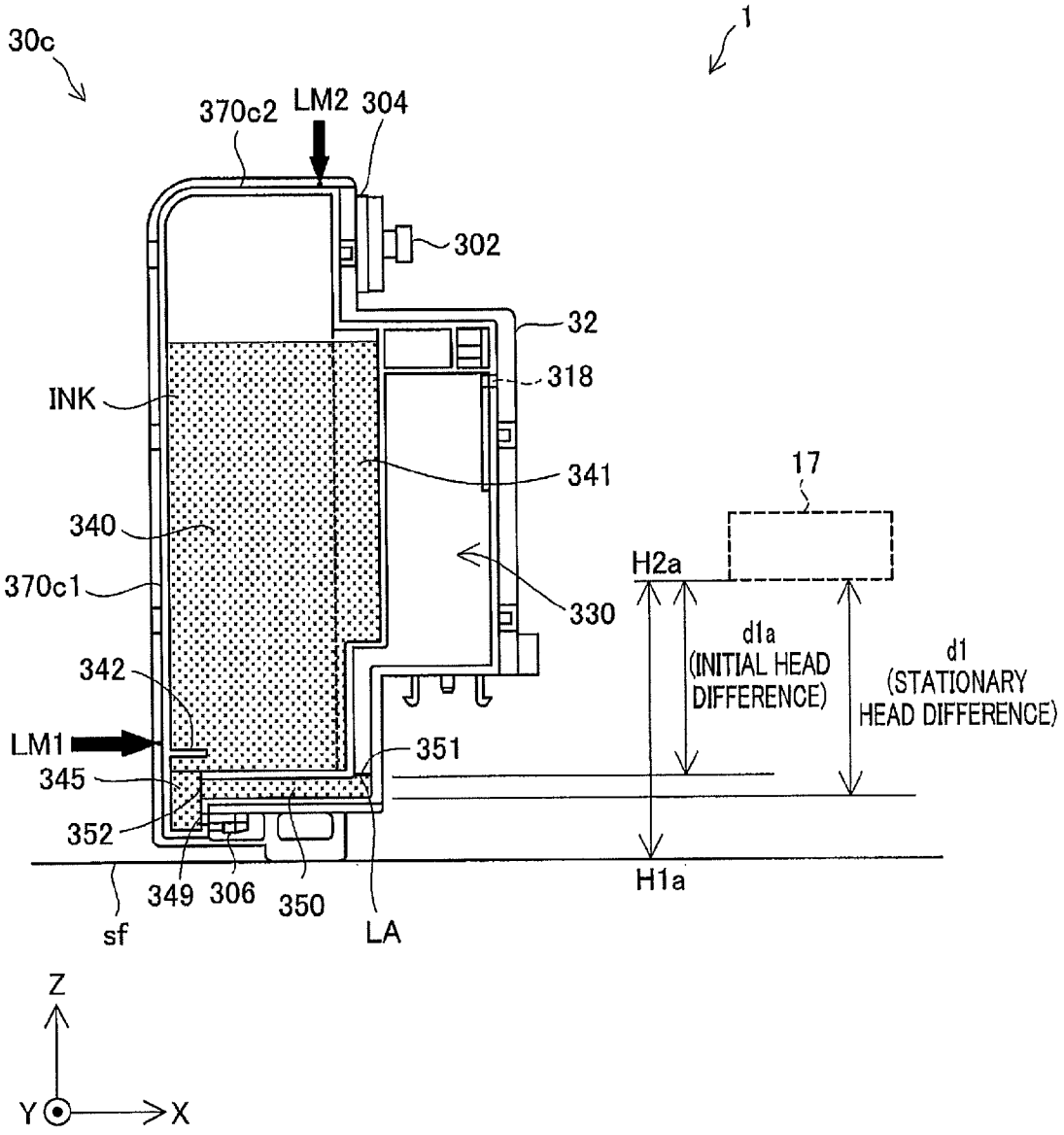
FIG. 21 is an explanatory diagram showing the state of ink in use attitude.

FIG. 21 is an explanatory diagram showing the state of ink in the ink tank 30*c* in the use attitude. FIG. 21 shows the immediate state of ink when the attitude of the ink tank 30*c* is changed from the filling attitude to the use attitude after filling ink into the liquid chamber 340 to such an extent that the ink level reaches the upper limit line LM2 in the filling attitude. This state is called "immediate state after filling". FIG. 21 is the view of the ink tank 30*c* seen from the positive direction of the Y axis.

As shown in FIG. 21, in the immediate state after filling, the liquid level directly exposed to the atmosphere (also called "atmosphere-exposed liquid level") LA is located close to the air-side opening 351. As the ink in the ink tank 30*c* is consumed in this state by suction from the recording head 17, the ink level near the air-side opening 351 moves into the second flow path 350 to form the meniscus in the second flow path 350. After formation of the meniscus, with consumption of ink in the liquid chamber 340, the ink level in the liquid chamber 340 is gradually lowered. When the ink level in the liquid chamber 340 approaches the lower limit line LM1, the user changes the attitude of the ink tank 30 from the use attitude to the filling attitude and fill (refill) ink through the liquid inlet 304 into the liquid chamber 340.

As shown in FIG. 21, in the immediate state after filling, the atmosphere-exposed liquid level LA is located in a height range of H1*a* to H2*a*. Like the first embodiment, the height range H1*a* to H2*a* is set to the height range of the atmosphere-exposed liquid level LA to enable the ink tank 30*c* to stably supply ink to the printer 12. This setting ensures stable ink supply from the ink tank 30*c* to the printer 12 even in the immediate state after filling. In other words, in the immediate state after filling, head difference d1*a* (also called "initial head difference d1*a*") caused by the difference in height in the vertical direction between the atmosphere-exposed liquid level LA and the recording head 17 is in a preset range that ensures stable ink supply.

B-4-3. Comparative Example

Figure 22:
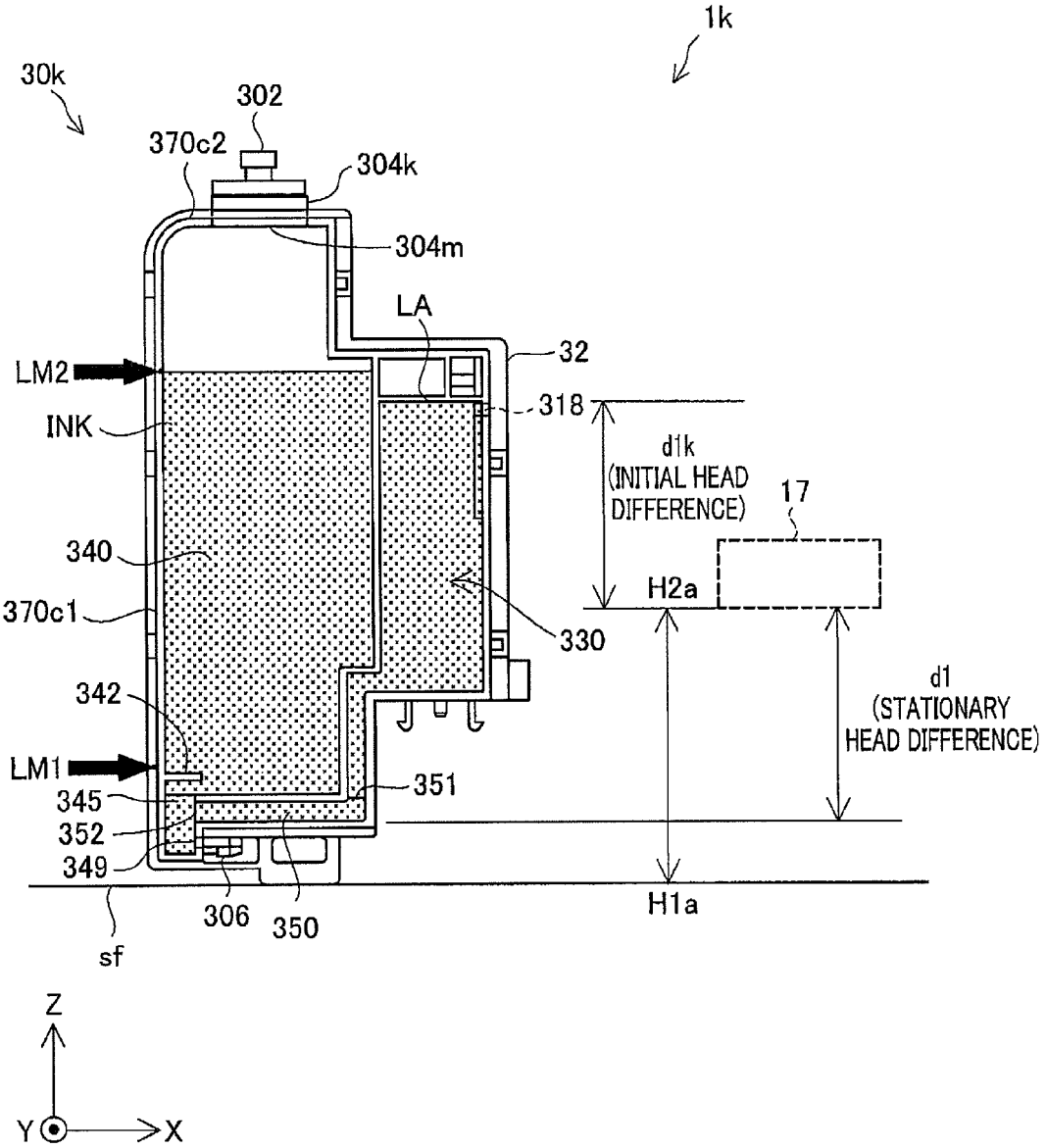
FIG. 22 is an explanatory diagram showing a liquid ejection system 1*k* according to a comparative example.

FIG. 22 is an explanatory diagram showing a liquid ejection system 1*k* according to a comparative example. FIG. 22 shows the state immediately after the user fills ink into an ink tank 30*k* as the ink in the ink tank 30*k* is consumed. The difference from the fourth embodiment is the structural difference between the ink tank 30*c* and the ink tank 30*k*. The structure of the printer 12 (FIGS. 17A and 17B) and the other structures are similar to those of the fourth embodiment. The ink tank 30*k* of the comparative example does not change its attitude between the filling attitude and the use attitude. In the ink tank 30*k*, a liquid inlet 304*k* is accordingly provided in the second wall member 370*c*2. Both a lower limit line LM1 and an upper limit lime LM2 are provided on the first wall member 370*c*1.

When the ink level in the liquid chamber 340 reaches the lower limit line LM1 with consumption of ink in the ink tank 30*k*, the user fills (refills) ink through the liquid inlet 304*k* into the ink tank 30*k* kept in the attitude of FIG. 22. It is here assumed that the user fills the same amount of ink as that filled in the above fourth embodiment into the liquid chamber 340. This means that the user fills ink into the ink tank 30*k* until the ink level reaches the upper limit line LM2 shown in FIG. 22.

Unlike the ink tank 30*c* of the fourth embodiment, in the ink tank 30*k*, a second flow path 350 including an airside opening 351 is located below a lower end 304*m* of the liquid inlet 304*k* in the filling attitude. As the ink is filled into the liquid chamber 340, the ink is introduced into the air chamber 330 via the second flow path 350. In the immediate state after filling, the air chamber 330 is filled with ink, so that ink overflows from the open-air hole 318. When ink overflows from the open-air hole 318, the sheet member 316 (FIGS. 6 and 8) is wetted with ink and impairs its original function. In the immediate state after filling, the atmosphere-exposed liquid level LA is located higher than the recording head 17. This may result in leakage of ink from the recording head 17 by the liquid pressure applied by the ink tank 30*k*. This causes significant deviation of initial head difference d1*k* from the stationary head difference d1 and may interfere with stable supply of ink from the ink tank 30*k* to the printer 12.

As explained above, like the ink tanks 30, 30*a* and 30*b* of the above first through third embodiments, the ink tank 30*c* of the fourth embodiment changes the attitude between the use attitude and the filling attitude. Like the ink tanks 30, 30*a* and 30*b* of the above first through third embodiments, in the ink tank 30*c*, the airside opening 351 is located above the lower end 304*m* of the liquid inlet 304 in the filling attitude. This structure lowers the probability that ink is introduced into the air chamber 330 during ink filling and thereby the probability that ink overflows from the open-air hole 318 provided in the air chamber 330 during ink filling. Lowering the possibility that ink is introduced into the air chamber 330 during ink filling enables the atmosphere-exposed liquid level LA in the immediate state after filling to be maintained in the preset height range (i.e., height H1*a* to height H2*a*). In other words, the head difference caused by the difference in height between the atmosphere-exposed liquid level LA and the recording head 17 is maintained in the preset range. This ensures stable ink supply from the ink tank 30 to the recording head 17. The presence of the lower limit line LM1 and the upper limit line LM2 facilitates the user to visually check the ink level in the liquid chamber 340 in the respective attitudes. The user can thus readily check the ink refill timing and the ink refill completion timing. The lower limit line LM1 and the upper limit line LM2 form the horizontal line in the respective attitudes (use attitude and filling attitude), so that the user can readily determine whether the ink tank 30*c* is located on the horizontal surface by comparing the ink level with either the lower limit line LM1 or the upper limit line LM2. Inclination of the lower limit line LM1 or the upper limit line LM2 to the ink level means that the ink tank 30*c* is not located on the horizontal surface.

Figure 23:
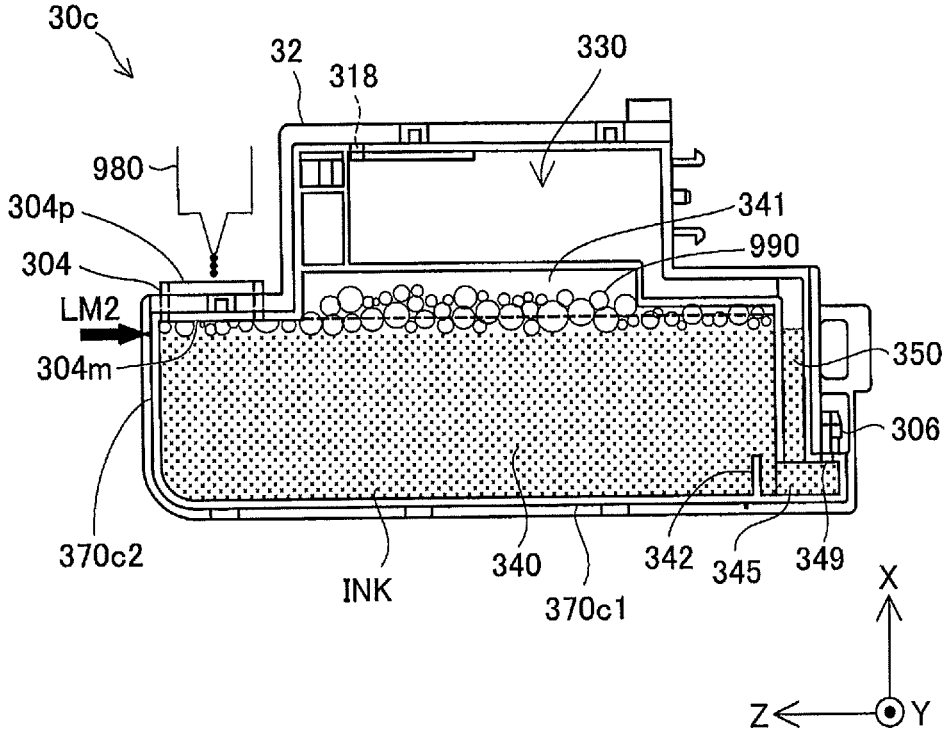
FIG. 23 is an explanatory diagram showing ink filling into the ink tank 30*c*.

FIG. 23 is an explanatory diagram showing ink filling into the ink tank 30*c*. FIG. 23 is the view corresponding to FIG. 20B. The only difference of FIG. 23 from FIG. 20B is generation of bubbles 990 in the liquid chamber 340 during ink filling into the liquid chamber 340. The bubbles 990 may be generated in the liquid chamber 340 when ink is filled into the liquid chamber 340. In this case, as the ink is filled into the liquid chamber 340 to raise the ink level, the bubbles 990 move up. The liquid chamber 340 includes a specific space 341, which is open downward in the vertical direction (negative direction of the X axis) and is located above the lower end 304*m* of the liquid inlet 304 in the filling attitude. This structure enables the bubbles 990 floating on the ink level to be accumulated in (released to) the specific space 341. This accordingly lowers the probability that the bubbles 990 generated in the liquid chamber 340 during ink filling overflow from the liquid inlet 304.

As described above, the ink tank 30*c* of the fourth embodiment has the specific space 341 in the liquid chamber 340 and lowers the probability that the bubbles 990 generated during ink filling overflow from the liquid inlet 304, compared with the conventional ink tank without the specific space 341. Additionally, the liquid outlet 349 of the liquid discharge port 306 is located below the specific space 341 in the filling attitude of the ink tank 30. This structure lowers the probability that the bubbles 990 being generated during ink filling and floating on the ink level enter the recording head 17 of the printer 12 via the liquid discharge port 306 and the hose 24 (FIG. 7). In the liquid ejection system 1*c* including the ink tanks 30*c*, this structure prevents the failure of the printer 12, such as missing dots. The ink tank 30 of the first embodiment or the ink tank 30*a* (FIG. 8, FIGS. 14A and 14B) of the second embodiment having the specific space 341 or 341*a* has the similar effects to those of the fourth embodiment.

B-5. Fifth Embodiment

Figure 24A:
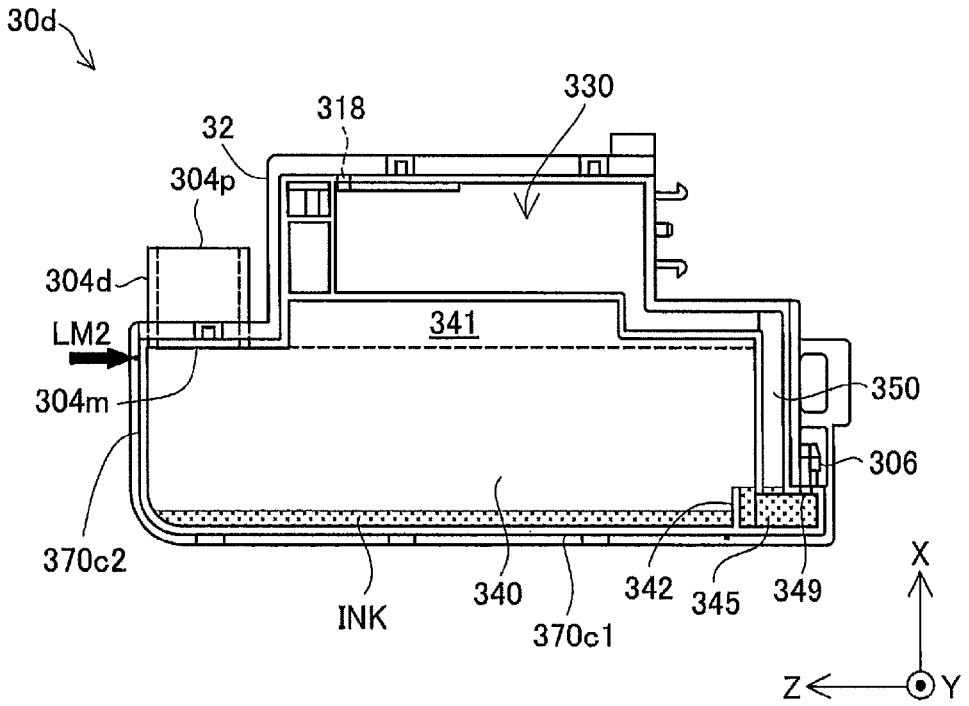
FIGS. 24A and 24B are explanatory diagrams showing an ink tank 30*d* according to a fifth embodiment.
Figure 24B:
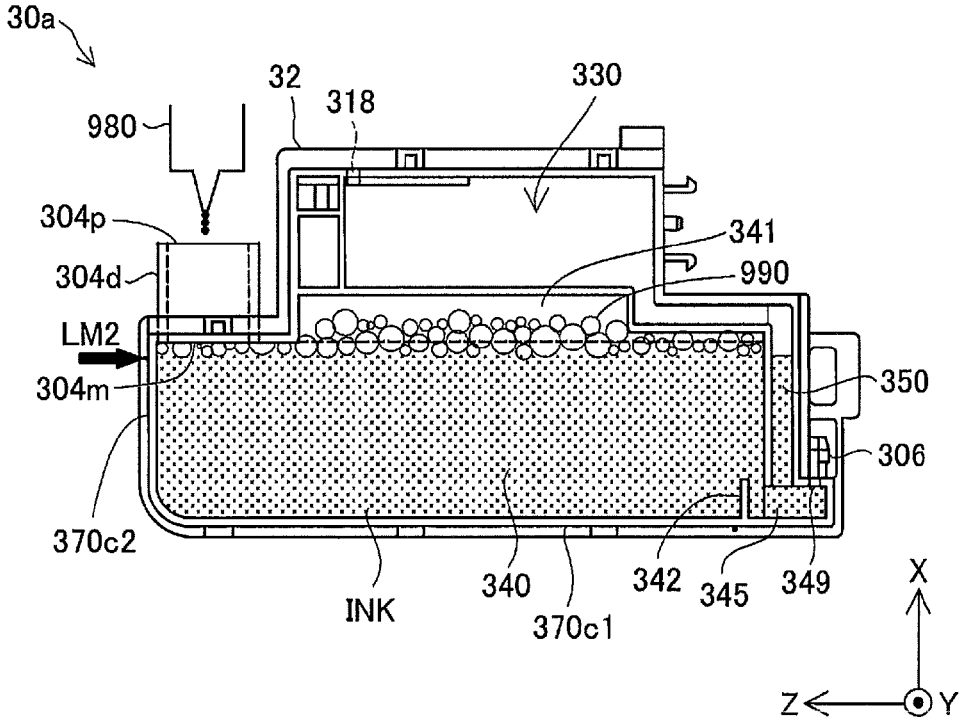

FIGS. 24A and 24B are explanatory diagrams showing an ink tank 30*d* according to a fifth embodiment. FIG. 24A is the view corresponding to FIG. 20A, and FIG. 24B is the view corresponding to FIG. 20B. The difference from the ink tank 30*c* of the fourth embodiment is the shape of a liquid inlet 304*d* included in the tank main body 32. Otherwise the structures of the fifth embodiment (e.g., liquid chamber 340 and specific space 341) are similar to those of the ink tank 30*c* of the fourth embodiment and are thus expressed by the like numerals and symbols and are not specifically described here. The other structures of the tank unit 50 including the upper casing 54 and the structure of the printer 12 are also similar to those of the fourth embodiment and are thus not specifically described here.

As shown in FIG. 24A, the ink tank 30*d* has the liquid inlet 304*d*. An upper end 304*p* of the liquid inlet 304*d* is located above the specific space 341 in the filling attitude of the ink tank 30*d*.

As shown in FIG. 25B, when ink is filled into the liquid chamber 340 to such an extent that the ink level in the liquid chamber 340 reaches the upper limit line LM2, the bubbles 990 on the ink level are accumulated in the specific space 341 as discussed in the same manner as the fourth embodiment. Part of the bubbles 990 generated during ink filling is present near the liquid inlet 304*d* (more specifically, a lower end 304*m*). Since the upper end 304*p* of the liquid inlet 304*d* of the fifth embodiment is located above the specific space 341 in the filling attitude, this structure further lowers the probability that the bubbles 990 overflow from the liquid inlet 304*d*, compared with the fourth embodiment.

C. Modified Examples

Among the various features of the invention included in the above embodiments, those other than the features disclosed in independent claims are additional and supplementary and may be omitted according to the requirements. The invention is not limited to the above embodiments or aspects but various modifications may be made to the embodiment without departing from the scope of the invention. Some of possible modifications are given below. The features having the specific advantageous effects in the respective embodiments may be combined according to the requirements.

C-1. First Modified Example

The second embodiment has the air reserving space 341*a* of the volume V1 (FIG. 14A). The air reserving space 341*a* of the volume V1 may, however, be omitted, as long as the liquid inlet 304*a* is located below one end 351 of the connection path 350 in the filling attitude. This modified structure still prevents ink from being introduced into the air chamber 330 and maintains the head difference in the use attitude in the preset range even when an excess amount of ink is filled into the liquid chamber 340*a*.

C-2. Second Modified Example

Although any of the ink tanks 30 to 30*d* has the liquid retainer 345 in the above embodiments, the liquid retainer 345 may be omitted. In other words, the partition wall member 342 may be omitted from the liquid chamber 340 or 340*a*. Like the above embodiments, this modified structure also lowers the probability that ink overflows from the open-air hole 318 during ink filling.

C-3. Third Modified Example

In the above embodiments, the liquid inlet 304, 304*a* or 304*d* is located below the open-air hole 318 in the filling attitude. The height relationship between the liquid inlet 304, 304*a* or 304*d* and the open-air hole 318 in the filling attitude is, however, not restricted to this relationship. For example, the liquid inlet 304, 304*a* or 304*d* may be located at the higher position than the open-air hole 318 in the filling attitude. The presence of the liquid retainer 345 or 345*b* in the ink tank 30, 30*a* or 30*d* enables this modified structure to lower the probability that the air flows into the recording head 17 during ink filling, like the embodiments discussed above.

C-4. Fourth Modified Example

In the above embodiments, the liquid inlet 304, 304*a* or 304*d* is provided on the air-side wall member 370*c*3 located close to the air chamber 330 out of the vertically-angled wall members that are vertically-angled relative to the mounting surface sf in the use attitude among the plurality of wall members defining the liquid chamber 340. This is, however, not restrictive but the liquid inlet 304 may be provided on any of the plurality of wall members defining the liquid chamber 340. In this case, it is preferable to provide the liquid inlet 304 on the wall member such that the upper end 304*p* of the liquid inlet 304 is open toward the horizontal direction in the use attitude and open upward in the vertical direction in the filling attitude, in order to urge the user to change the attitude of the ink tank 30 to the filling attitude at the time of ink filling. For example, when the liquid inlet 304 is provided on the second wall member 370*c*2 (FIG. 18), the liquid inlet 304 is designed to be extended upward (positive direction of the Z axis) from the second wall member 370*c*2 and bent in the middle toward the air chamber 330 (positive direction of the X axis).

In the above embodiments, the liquid inlet 304, 304*a* or 304*d* is formed in the cylindrical shape extended by a predetermined length from the wall member of the liquid chamber 340 (FIG. 8). This is, however, not restrictive but the liquid inlet 304 may be formed such that one end or upper end 304*p* is open to the outside and the other end or lower end 304*m* is open to the liquid chamber 340. For example, the liquid inlet may be a through-hole formed in the wall member of the liquid chamber 340. In the liquid inlet formed as the through-hole in the wall member, the lower end 304*m* is a portion (face) open to the liquid chamber 340 and the upper end 304*p* is a portion (face) open to the outside. This modified structure of forming the liquid inlet as the through-hole in the wall member of the liquid chamber 340 does not require the cylindrical member extended by the predetermined length from the wall member. Like the embodiments discussed above, the presence of the specific space 341 or 341*a* lowers the probability that the bubbles 990 generated during ink filling overflow from the liquid inlet formed as the through-hole.

C-5. Fifth Modified Example

In the fourth embodiment discussed above, the lower limit line LM1 and the upper limit line LM2 are formed as straight lines. This is, however, not restrictive but the lower limit line LM1 and the upper limit line LM2 may be any indications that enable the ink level in the liquid chamber 340 to be observable from the outside. For example, at least one of the lower limit line LM1 and the upper limit line LM2 may be a dot. In another example, the lower limit line LM1 and the upper limit line LM2 may be colored in black or another adequate color. As at least one of the lower limit line LM1 and the upper limit line LM2, a plurality of lines (indications) may be provided at different heights in the vertical direction in each of the use attitude and the filling attitude. Providing the plurality of indications enables the user to check the ink level in the liquid chamber 340 with higher accuracy.

C-6. Sixth Modified Example

The tank main body 32 including the first wall member 370*c*1 and the second wall member 370*c*2 is made translucent in the above embodiments, but may alternatively be made transparent. As long as at least a portion of the ink tank 30 has a visible part that enables the ink level inside the ink tank 30 to be visible from outside, the residual part of the ink tank 30 may be designed to be invisible from the outside. More specifically, the lower limit line LM1 as the lower limit element may be provided on the first wall member 370*c*1 that is visible from the outside and has a first visible part enabling the inside of the liquid chamber 340 to be visible from the outside. The lower limit line LM1 may be provided in a specific height range including the first visible part in the use attitude. The first visible part may be transparent or translucent. The upper limit line LM2 as the upper limit element may be provided on the second wall member 370*c*2 that is visible from the outside and has a second visible part enabling the inside of the liquid chamber 340 to be visible from the outside. The upper limit line LM2 may be provided in a specific height range including the second visible part in the filling attitude. This modified structure facilitates the user to visually check that the ink level in the liquid chamber 340 reaches the first threshold value or the second threshold value.

C-7. Seventh Modified Example

In the above embodiments, the specific space 341 or 341*a* is provided between the lower end 304*m* of the liquid inlet 304 and the liquid outlet 349 of the liquid discharge port 306 in the vertical direction (Z-axis direction) in the use attitude in the liquid chamber 340 (for example, FIGS. 14A, 14B, 23, 24A, and 24B). This is, however, not restrictive. For example, the specific space 341 may be provided at a position opposed to the liquid outlet 349 across the lower end 304*m* of the liquid inlet 304, 304*a* or 304*d* in the vertical direction (Z-axis direction) in the use attitude in the liquid chamber 340. In other words, the specific space 341, the lower end 304*m* of the liquid inlet 304 and the liquid outlet 349 may be disposed in this sequence downward in the vertical direction in the use attitude. Like the embodiments discussed above, the presence of the specific space 341 or

341*a* lowers the probability that the bubbles 990 generated during ink filling overflow from the liquid inlet formed as the through-hole.

C-8. Eighth Modified Example

The upper limit line LM2 as the upper limit element and the lower limit line LM1 as the lower limit element may be provided on any one of the ink tanks 30 to 30*d* of the above embodiments. The upper limit line LM2 as the upper limit element and the lower limit line LM1 as the lower limit element may otherwise be provided on a liquid container other than the ink tanks 30 to 30*d* of the above embodiments. For example, the ink tanks 30 to 30*d* of the above embodiments have the second flow path 350 and the air chamber 330, but the second flow path 350 and the air chamber 330 may be omitted. The upper limit line LM2 and the lower limit line LM1 may be provided on an ink tank (liquid container) that has the liquid chamber 340, the liquid inlet 304, the liquid discharge port 306 and an introducing portion for introducing the air into the liquid chamber with consumption of ink (liquid) in the liquid chamber 340 and changes the attitude between the filling attitude and the use attitude. More specifically, in the ink tank (liquid container) having different wall members defining the bottom face in the filling attitude and in the use attitude, the lower limit element LM1 may be provided on the first wall member 370*c*1, and the upper limit element LM2 may be provided on the second wall member 370*c*2 different from the first wall member 370*c*1. The first wall member 370*c*1 is vertically-angled relative to the mounting surface in the use attitude. The second wall member 370*c*2 is vertically-angled relative to the mounting surface in the filling attitude. Like the above fourth embodiment, this structure facilitates the user to check the ink level in the liquid chamber 340 in the respective attitudes. In the ink tank 30 without a flow path that allows for formation of the meniscus, it is preferable to move the ink tank 30 in the vertical direction as the atmosphere-exposed liquid level LA is lowered with consumption of ink in the liquid chamber 340 and thereby keep the fixed height relationship between the atmosphere-exposed liquid level LA and the recording head 17. This maintains the height relationship between the recording head 17 and the atmosphere-exposed liquid level LA in a preset range and keeps the constant head difference.

C-9. Ninth Modified Example

The above embodiments and modified examples describe the ink tanks 30 to 30*d* as the liquid container applicable to the printer 12. This is, however, not restrictive but the present invention is applicable to a liquid container for supplying a liquid to any of various liquid ejection apparatuses, for example, an apparatus equipped with a color material ejection head, such as liquid crystal display, an apparatus equipped with an electrode material (conductive paste) ejection head used for formation of electrodes, such as organic EL display or surface emitting display (FED), an apparatus equipped with a bio-organic matter ejection head used for production of biochips, an apparatus equipped with a sample ejection head as a precision pipette, a printing apparatus or a micro dispenser. The liquid container includes a liquid inlet provided to fill a liquid into the liquid container, separately from an open-air hole provided to introduce the air into the liquid container. In application of the liquid container to any of these various liquid ejection apparatuses, the liquid container stores a liquid (e.g., color material, conductive paste or bio-organic matter) corresponding to the type of the liquid to be ejected from the liquid ejection apparatus. The invention is also applicable to a liquid ejection system including one of these various liquid ejection apparatuses and a liquid container corresponding to the liquid ejection apparatus.

What is claimed is:

1. A liquid tank unit, comprising:

a liquid tank configured to store a liquid to be supplied to a liquid jet head;

a liquid inlet on the liquid tank, the liquid inlet configured to allow liquid to be filled into the liquid tank;

a casing covering at least a part of the liquid tank; and a cover pivotally engaged with the casing at a pivot engagement;

wherein the pivot engagement is located at a position lower than a position of the liquid inlet when the liquid tank is in a liquid filling attitude;

wherein the liquid tank includes a wall having a vertical orientation with respect to a mounting surface of the liquid tank unit when the liquid tank is in the liquid filling attitude, the wall comprising an upper limit line; and wherein the pivot engagement of the cover is located at a position lower than the upper limit line when the liquid tank is in the liquid filling attitude.

2. The liquid tank unit according to claim 1, wherein the upper limit line is visible when the cover is opened about the pivot engagement when the liquid tank is in the liquid filling attitude.

3. The liquid tank unit according to claim 1, wherein the liquid inlet faces in a direction intersecting a horizontal direction when the liquid tank is in the liquid filling attitude.

4. The liquid tank unit according to claim 1, comprising a plug member detachably attached to the liquid inlet and sealing the liquid inlet which attached thereto.

* * * * *